US007265727B2

(12) United States Patent
Connor

(10) Patent No.: US 7,265,727 B2
(45) Date of Patent: Sep. 4, 2007

(54) TOP LOADED DISK MONOPOLE ANTENNA

(75) Inventor: Wendy A. Connor, Santa Barbara, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/144,145

(22) Filed: Jun. 3, 2005

(65) Prior Publication Data

US 2006/0273971 A1 Dec. 7, 2006

(51) Int. Cl.
*H01Q 9/00* (2006.01)

(52) U.S. Cl. ..... 343/752; 343/749; 343/846

(58) Field of Classification Search ..... 343/752, 343/749, 781 P, 781 CA, 846, 829, 828
See application file for complete search history.

(56) References Cited

U.S. PATENT DOCUMENTS

| | | | | |
|---|---|---|---|---|
| 5,706,016 | A * | 1/1998 | Harrison, II | 343/752 |
| 6,512,485 | B2 * | 1/2003 | Luly et al. | 343/781 CA |
| 7,027,002 | B2 * | 4/2006 | Suh et al. | 343/773 |
| 2005/0062670 | A1 | 3/2005 | Seong-Youn et al. | |
| 2005/0168398 | A1 * | 8/2005 | Hasegawa et al. | 343/828 |
| 2005/0233786 | A1 * | 10/2005 | Hatch | 455/575.7 |

FOREIGN PATENT DOCUMENTS

| | | |
|---|---|---|
| EP | 1443593 A | 8/2004 |
| JP | 2003 198236 | 7/2003 |
| JP | 2003 273638 | 9/2003 |

OTHER PUBLICATIONS

"Wide-Band Planar Monopole Antennas", Agrawall, N.P., et al., IEEE Transactions On Antennas And Propagation, vol. 46, No. 2, Feb. 1998, 2 pages.
"Spiral Slot Patch Antenna And Circular Disc Monopole Antenna for 3.1-10.6 GHz Ultra Wideband Communication", Powell, Johna et al., International Symposium on Antennas and Propagation, Aug. 2004, 4 pages.
"A Brief History Of UWB Antennas", Schantz, Hans Gregory, AES-M, Apr. 2004, 5 pages.
Agrawall, Naraya Prasad et al., Wide-band planar monopole antennas, IEEE Transactions on Antennas and Propagation, IEEE Service Center, Piscataway NJ, vol. 46, No. 2. Feb. 1998, whole document.
Foltz, H. D. et al., Disk-loaded monopoles with parallel strip elements, IEEE Transactions on Antennas and Propagation, IEEE Service Center, Piscataway NJ, vol. 46, No. 12, Dec. 1988, abstract; figure 1.

* cited by examiner

*Primary Examiner*—Hoang V. Nguyen
(74) *Attorney, Agent, or Firm*—Leonard A. Alkov

(57) ABSTRACT

In an exemplary aspect of the invention, an antenna is disclosed that includes a ground plane and a disk disposed adjacent to the ground plane. The disk has a perimeter. The antenna further includes a loading reflector having an underside. At least a portion of the underside is electrically connected to a portion of the perimeter of the disk. The loading reflector has a width at a widest point, and the width at the widest point of the loading reflector is larger than a thickness of the disk. The disk may be circular or elliptical. The ground plane may include a cavity, where the disk is disposed within an outer border of the cavity. When an elliptical disk is used, the cavity may also be elliptical. An elliptical cavity may have a parabolic surface.

30 Claims, 20 Drawing Sheets

TOP LOADED DISK MONOPOLE ANTENNA

STATEMENT OF GOVERNMENT INTERESTS

The Government of the United States of America has certain rights in this invention pursuant to contract No. IOT-4400017426.

TECHNICAL FIELD

This invention relates generally to antennas and, more specifically, relates to antennas having disks.

BACKGROUND OF THE INVENTION

One type of monopole antenna includes a circular disk that is disposed near a flat ground plane. The circular disk is a radiating element and is spaced apart from the ground plane. This type of antenna is called a circular disk monopole antenna. Benefits of the circular disk monopole antenna include a very large impedance bandwidth pattern and circular polarization.

While the circular disk monopole antenna is a beneficial design, the design can still be improved.

BRIEF SUMMARY OF THE INVENTION

The present invention provides top loaded disk monopole antennas having, in exemplary embodiments, one or more benefits over the circular disk monopole antenna.

In an exemplary embodiment of the invention, an antenna is disclosed that comprises a ground plane and a disk disposed adjacent to the ground plane. The disk has a perimeter. The antenna further comprises a loading reflector having an underside. At least a portion of the underside is electrically connected to a portion of the perimeter of the disk. The loading reflector has a width at a widest point, and the width at the widest point of the loading reflector is larger than a thickness of the disk.

In another exemplary embodiment of the invention, an antenna comprises a ground plane comprising an elliptical cavity, and the elliptical cavity has a parabolic surface. The antenna additionally comprises an elliptical disk disposed adjacent to the elliptical cavity. The elliptical disk has a major axis substantially parallel to a plane intersecting an apex of the parabolic surface. The elliptical disk also has a minor axis substantially perpendicular to the plane. The antenna also comprises a feed comprising a first conductor coupled to the elliptical disk and a second conductor coupled to the ground plane. The antenna further comprises a loading reflector having an underside. At least a portion of the underside is electrically connected to a portion of the perimeter of the disk. The portion is substantially opposite the elliptical cavity.

In yet another exemplary embodiment of the invention, an antenna is disclosed that comprises means for reflecting radio frequency signals and means for radiating radio frequency signals. The radiating means is disposed adjacent to the reflecting means. The antenna also comprises means for focusing and reflecting radio frequency signals, and means for electrically coupling the focusing and reflecting means to the radiating means.

BRIEF DESCRIPTION OF THE DRAWINGS

The foregoing and other aspects of embodiments of this invention are made more evident in the following Detailed Description of Exemplary Embodiments, when read in conjunction with the attached Drawing Figures, wherein.

DETAILED DESCRIPTION OF EXEMPLARY EMBODIMENTS

While the circular disk monopole antenna is a beneficial antenna, certain embodiments of the present invention provide advantages over the circular disk monopole antenna. Examples of advantages are as follows. An exemplary top loaded elliptical disk monopole antenna is approximately a 12 to one broadband antenna. In places, the radiation patterns from an exemplary top loaded elliptical disk monopole antenna exhibit five decibels (dB) or more gain over the circular disk monopole. An exemplary top loaded elliptical disk monopole antenna can be used in applications where aerodynamic shape is important. Since the cross-pole of an exemplary top loaded elliptical disk monopole antenna is high, the top loaded elliptical disk monopole antenna can be used to detect in multiple polarizations. The top loaded elliptical disk monopole antenna is a simple, low cost design that can be used in a wide variety of applications, such as cellular phone systems.

Figure 1:
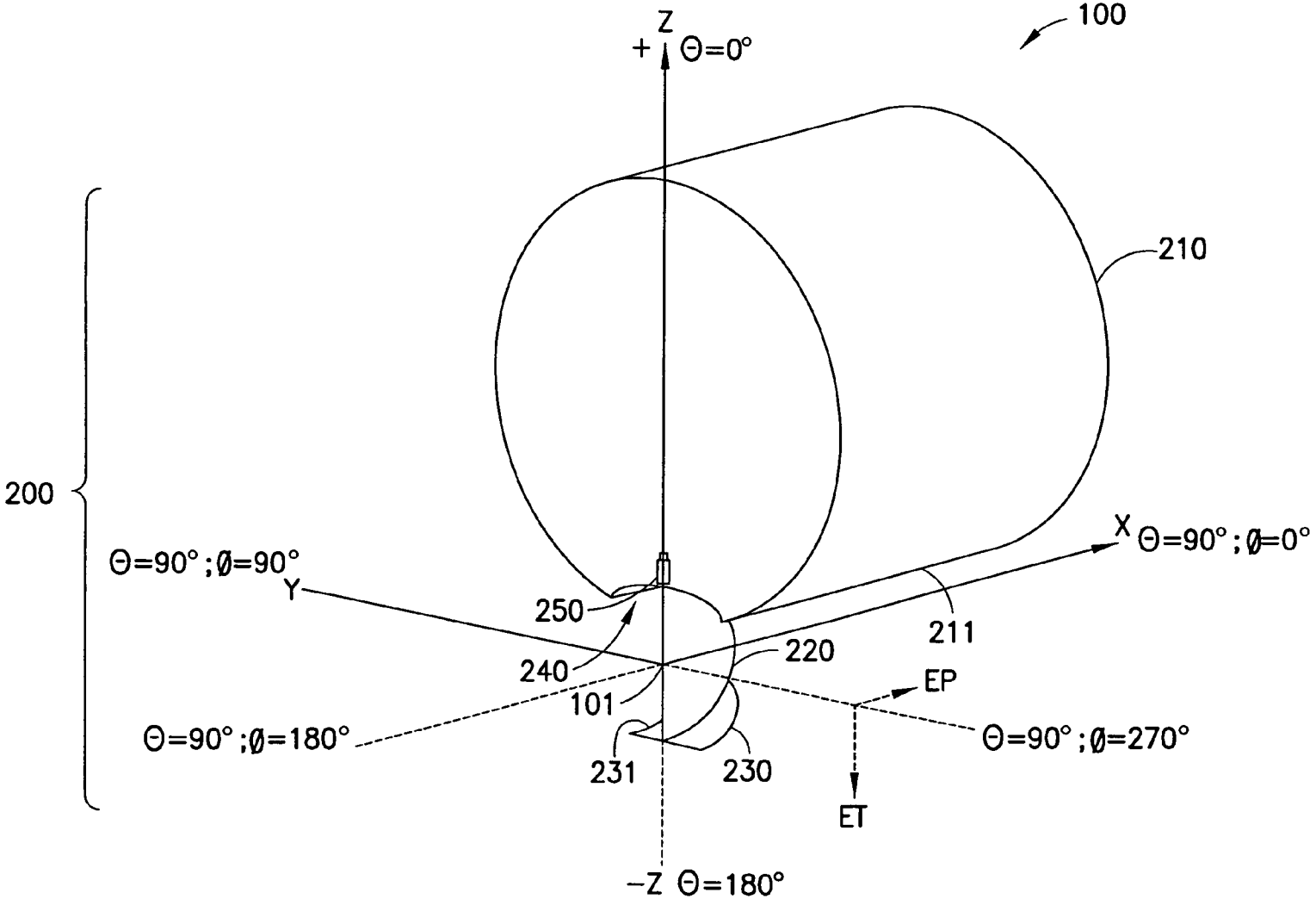
FIG. 1 is an illustration of a spherical coordinate system having an exemplary top loaded elliptical disk monopole antenna in accordance with an exemplary embodiment of the present invention.

Turning now to FIG. 1, FIG. 1 is an illustration of a spherical coordinate system 100 having an exemplary top loaded elliptical disk monopole antenna 200 shown thereon in accordance with an exemplary embodiment of the present invention. Spherical coordinate system 100 has x, y, and z axes that meet at origin 201. The vertical Eθ (ET) and horizontal Eϕ (EP) orientations are shown. Top loaded elliptical disk monopole antenna 200 comprises a ground plane 210, an elliptical disk 220, a loading reflector 230, and a feed 250. The feed 250 will be described herein as an SMA input, although other types of feeds may be used. The feed 250 is used to transmit or receive Radio Frequency (RF) signals. The ground plane 210 comprises in an exemplary embodiment elliptical cavity 240 (e.g., formed as portion of surface 211 of the ground plane 210).

The elliptical disk 220 is disposed adjacent to the ground plane 210, and in particular the elliptical cavity 240. Note that the ground plane 210 is shown as a cylindrical ground plane. However, a cylindrical ground plane is not necessary and in experiments, a relatively flat ground plane 210 (e.g., except for elliptical cavity 240) comprised of copper tape was used. A large portion or all of the ground plane 210 will typically be flat and comprised of a conductive material. The ground plane 210 can be considered, e.g., to function as a reflector of RF signals and, when the ground plane 210 comprises elliptical cavity 240, functions as a focusing reflector of RF signals.

As can be seen in FIG. 1, the loading reflector 230 has an underside 231. The underside 231 contacts and is electrically connected to a portion of the elliptical disk 220, as described in more detail below.

Figure 2:
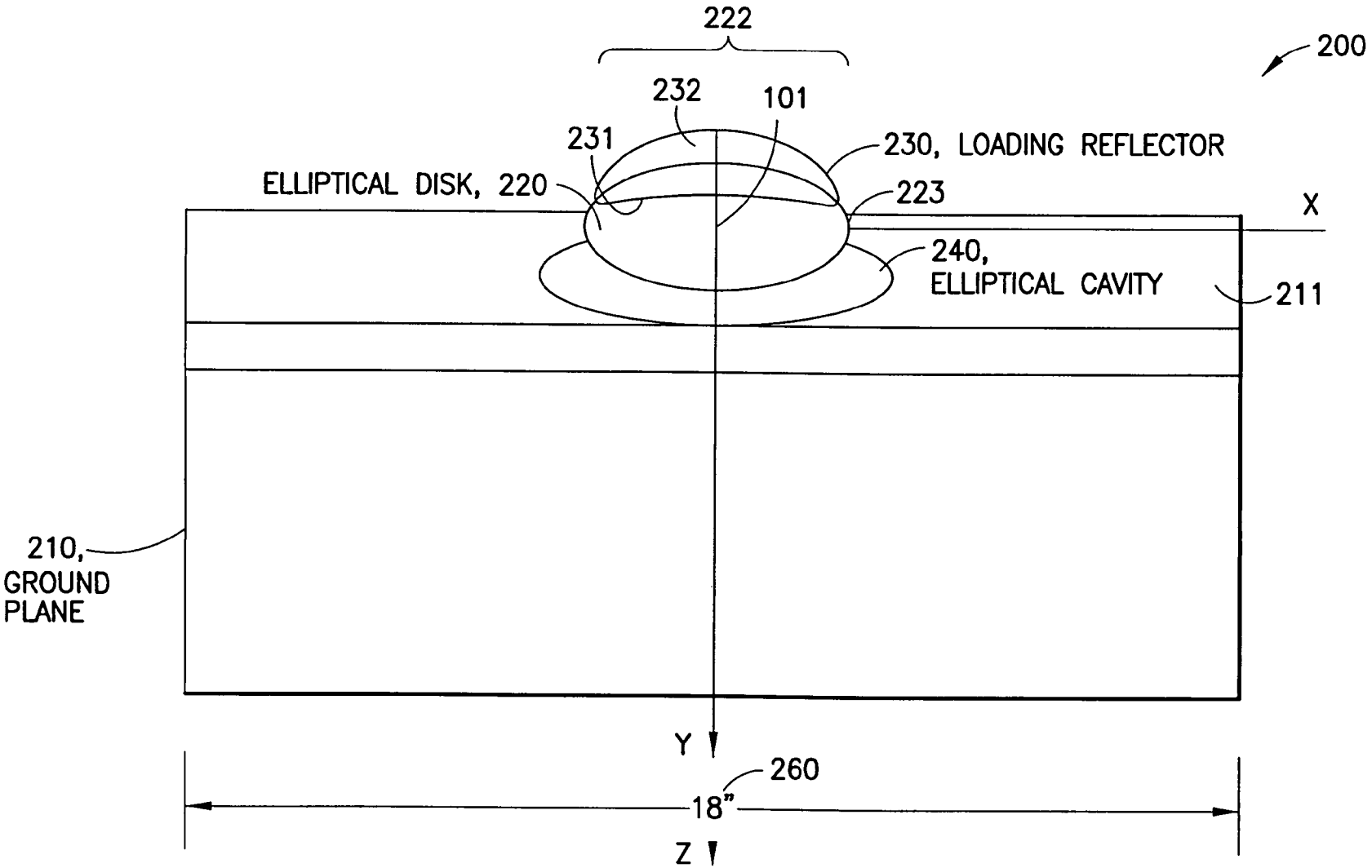
FIG. 2 is a side view (e.g., from a point of view relative to the origin shown in FIG. 1) of the top loaded elliptical disk monopole antenna shown in FIG. 1.

FIG. 2 is a side view (e.g., from a point of view relative to the origin 101 of FIG. 1) of the top loaded elliptical disk monopole antenna 200 shown in FIG. 1. For reference, the origin 101 is shown in FIG. 2. The topside 232 of the loading reflector 230 is shown. The loading reflector 230 is designed so that the underside 231 contacts a portion 222 o the perimeter 223 of the elliptical disk 220. The loading reflector 230 is in an exemplary embodiment designed to match the contour of the perimeter 223.

The elliptical disk 220 comprises a conductive material, such as copper or brass. The elliptical disk 220 can be considered to function as a radiator of RF signals, and any material suitable for radiating RF signals may be used. The loading reflector 230 comprises a conductive material, such as copper or brass, and is typically coupled to the elliptical disk 220 through welding, soldering, or the like. However, any material (e.g., means for coupling) may be used to couple the loading reflector 230 to the elliptical disk 220 that forms at least an electrical connection between the loading reflector 230 and the elliptical disk 220. Such material could include ribbon cables, conductive elastomers, and conductive adhesive (e.g., glue/epoxies). The loading reflector 230 can be considered to function to focus and reflect RF signals. The loading reflector 230 can focus and reflect RF signals primarily onto the elliptical disk 220, although there is also interplay between the ground plane 210 (e.g., the elliptical cavity 240) and the elliptical disk 220.

In the example of FIG. 2, the ground plane 210 has a length 260 of 18 inches. However, this length is merely exemplary. It should be noted that elliptical cavity 240 is optional (e.g., the ground plane 210 could have a flat surface 211). Additionally, the cavity 240 need not be elliptical (e.g., the cavity could be circular). However, as described in more detail below, an elliptical cavity 240 can provide radiation pattern and beam focus modification.

Figure 3:
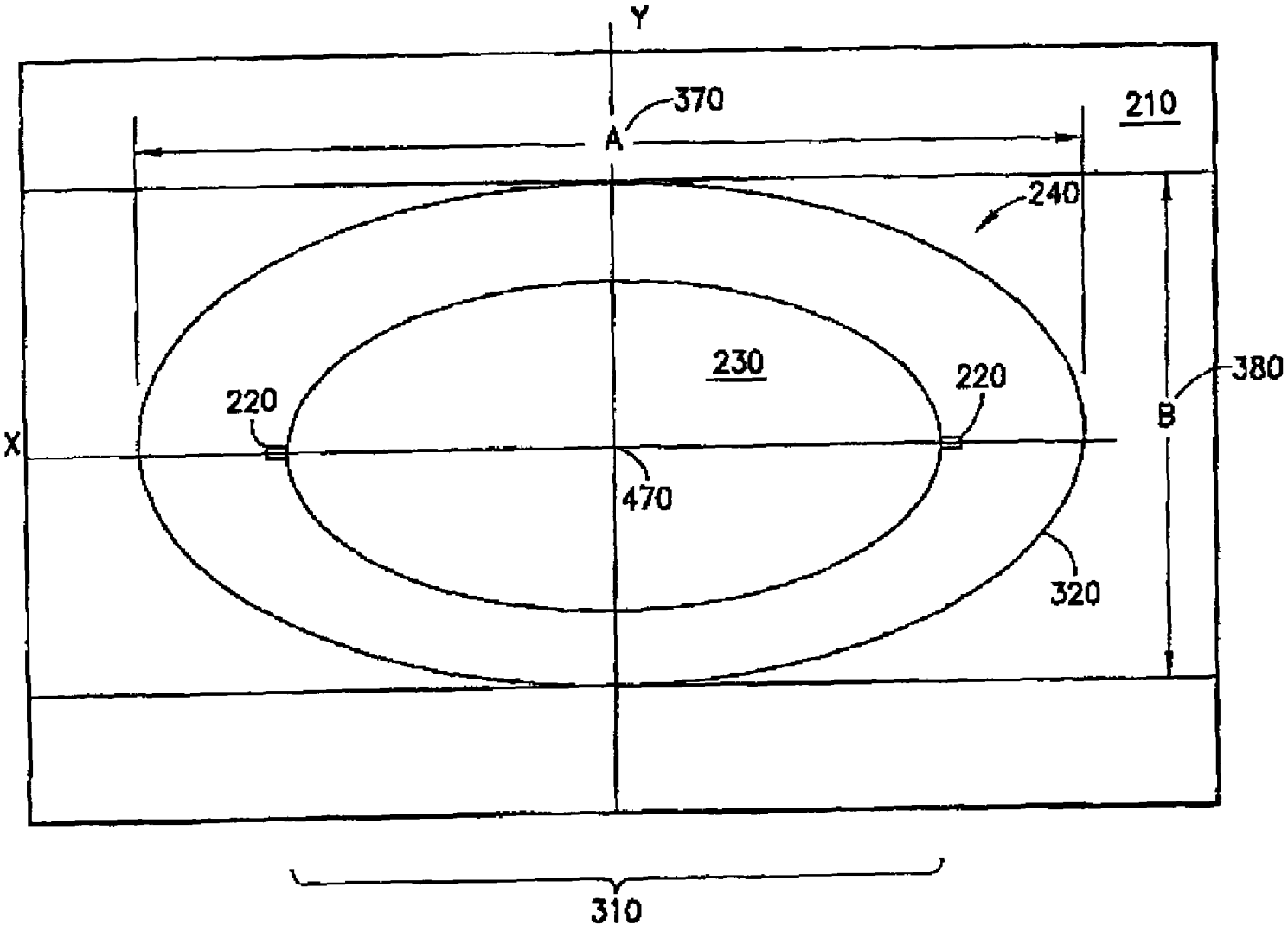
FIG. 3 is a top view (e.g., from a point of view relative to the x-y plane) of the top loaded elliptical disk monopole antenna shown in FIG. 1.

FIG. 3 is a top view (e.g., from a point of view relative to the x-y plane) of the top loaded elliptical disk monopole antenna 200 shown in FIG. 1. In this example, the elliptical cavity 240 of the ground plane has a width 380 of A inches and a length 370 of B inches. In an exemplary embodiment, the ratio of A to B is 1.9375. It should be noted that A could be less than or equal to B, if desired. The elliptical cavity 240 has a major axis (e.g., the x axis) along which the length 370 is defined and a minor axis (e.g., the y axis) along which the width 380 is defined. The loading reflector 230 has a length 310, which is typically the same as the portion 222 of the elliptical disk 220. The elliptical disk 220 has an outer border 320, which is typically sized so that the elliptical disk 220 and loading reflector 230 reside within the outer border 320. While not necessary, having the elliptical disk 220 and loading reflector 230 reside within the outer border is beneficial in providing higher reflected power, e.g., by better focusing a reflected beam onto the loading reflector 230 and by affecting radiation patterns. Additionally, the elliptical cavity 240 has beneficial effects on the radiation patterns produced by the top loaded elliptical disk monopole antenna 200.

The length 370 and width 380 of the elliptical cavity 240 may be modified, and such modification will result in radiation pattern changes. Exemplary radiation patterns are shown in FIGS. 10-20.

The length 310 of the loading reflector 230 may also be modified, although the effect of modifying the length 310 is smaller than is the effect caused by modifying the width (see FIG. 4) of the loading reflector 230. Note that the length 310 and the portion 222 of the elliptical disk 220 may not be the same (e.g., the loading reflector 230 could have a portion along its length 310 not in contact with the portion 222 of the top loaded elliptical disk monopole antenna 200).

Edges of the elliptical disk 220 can also be seen in FIG. 3. The elliptical disk 220 has a major axis (e.g., the x axis) and, while not necessary, the major axes of the elliptical disk 220 and the elliptical cavity 240 are typically substantially parallel and aligned (e.g., within plus or minus 10 degrees as measured from the y axis and within approximately one-quarter inch of each other). Additionally, although not required, the midpoint 470 of the loading reflector 230 is typically substantially aligned (e.g., within half an inch) with the minor axis (e.g., at another midpoint) of the elliptical disk 220.

Figure 4:
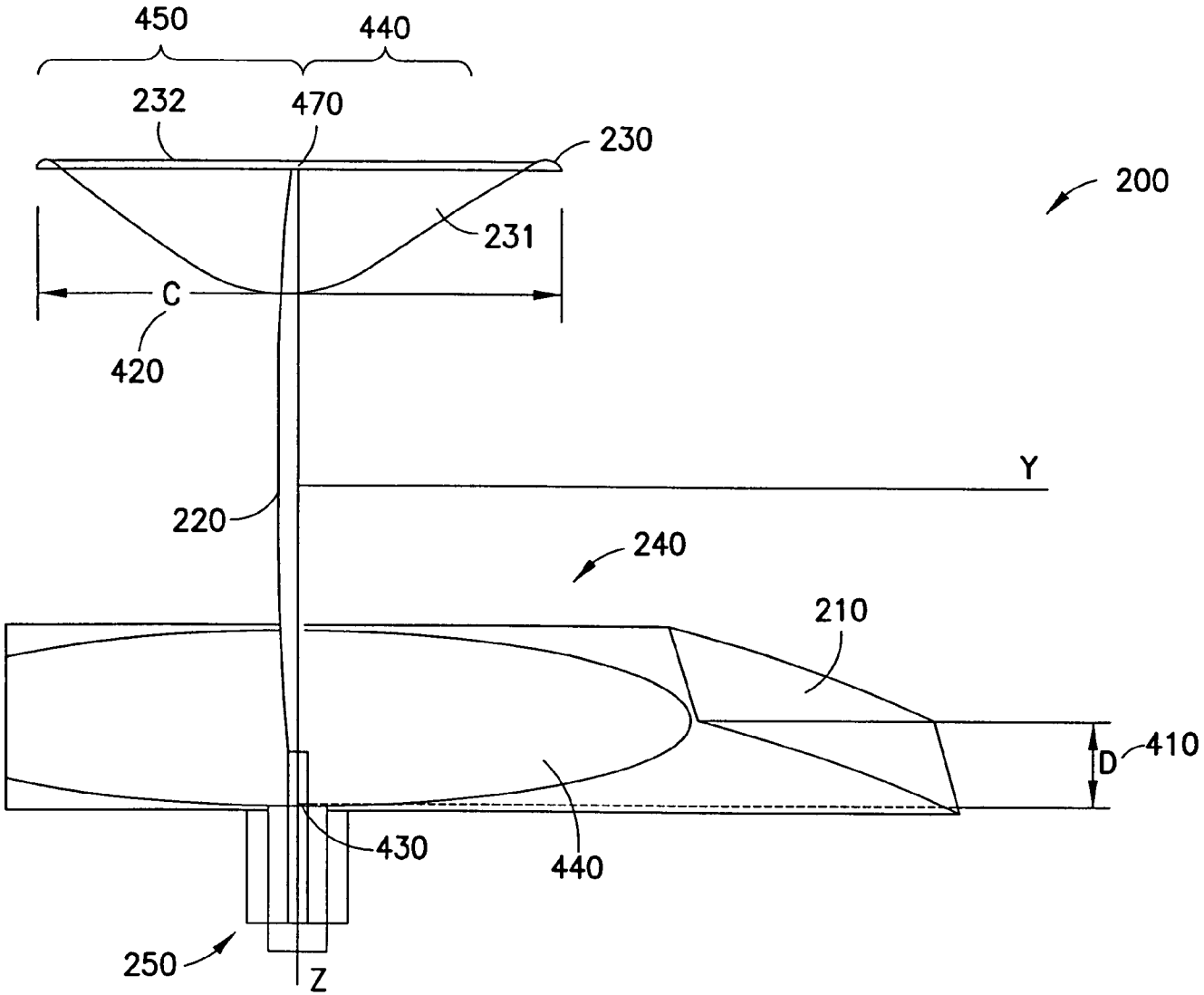
FIG. 4 is a cross-sectional end view (e.g., from a point of view relative to the y-z plane) of the top loaded elliptical disk monopole antenna shown in FIG. 1.

FIG. 4 is a cross-sectional end view (e.g., from a point of view relative to the y-z plane) of the top loaded elliptical disk monopole antenna 200 shown in FIG. 1. In this example, the underside 231 is formed to the match the contour of the perimeter 223 of the elliptical disk 220, especially in the portion 222 of the elliptical disk 220 over which the underside 231 (in this example) contacts and is electrically connected to the elliptical disk 220. The width 420 of C inches of the loading reflector 230 is a width at a widest point of the loading reflector 230.

The width 420 of the loading reflector 230 is an important parameter and modification of the width 420 has the greatest effect on a frequency range over which the top loaded elliptical disk monopole antenna 200 can communicate, relative to other possible modifications of parameters of the top loaded elliptical disk monopole antenna 200. However, modification of the width 420 can also change the radiation patterns of the top loaded elliptical disk monopole antenna 200. In an exemplary embodiment, the ratio of A to C is 2.9245.

In the figures, the loading reflector 230 is shown to be symmetric about the elliptical disk 220 (e.g., the axis along the length of the elliptical disk 220). However, the loading reflector 230 can be non-symmetric, if desired, and such non-symmetry will affect the radiation patterns of the top loaded elliptical disk monopole antenna 200. Nonetheless, sometimes a narrower radiation pattern is more desirable. For instance, the loading reflector 230 could be designed so that the partial width 450 at the widest point (e.g., represented by reference 420) is larger than the partial width 440 at the widest point of the loading reflector 230. This difference in partial widths 450, 440 will cause corresponding non-symmetries in the radiation patterns of the top loaded elliptical disk monopole antenna 200. Additionally, while the length 310 of the loading reflector 230 is shown larger than the width 420 of the loading reflector 230, the width 230 could be made larger than the length 310, although this will affect frequency range and radiation patterns.

FIG. 4 also illustrates that the elliptical cavity 240 has a depth 410 in this example of D inches. In an exemplary embodiment, the ratio of A to D is 13.1356. The depth 410 of the ground plane 210 can be modified, and such modification will result mainly in changing focus of an electromagnetic beam reflected from the elliptical cavity 240. The surface 440 is a parabolic surface and has an apex 430. Although other configurations are possible, the midpoint 470 of the loading reflector 230 is substantially opposite (e.g., within a half inch) the apex 430. The elliptical disk 220 has a minor axis (e.g., the z axis) and the minor axis is substantially perpendicular (e.g., within plus or minus 10 degrees of perpendicular) to a plane (e.g., a y-z plane) intersecting the apex 430. It should be noted that the minor axis of the elliptical disk 220 need not be substantially perpendicular to the plane intersecting the apex 430, but having the minor axis be substantially perpendicular to the plane intersecting the apex 430 provides more symmetric radiation patterns.

Figure 6:
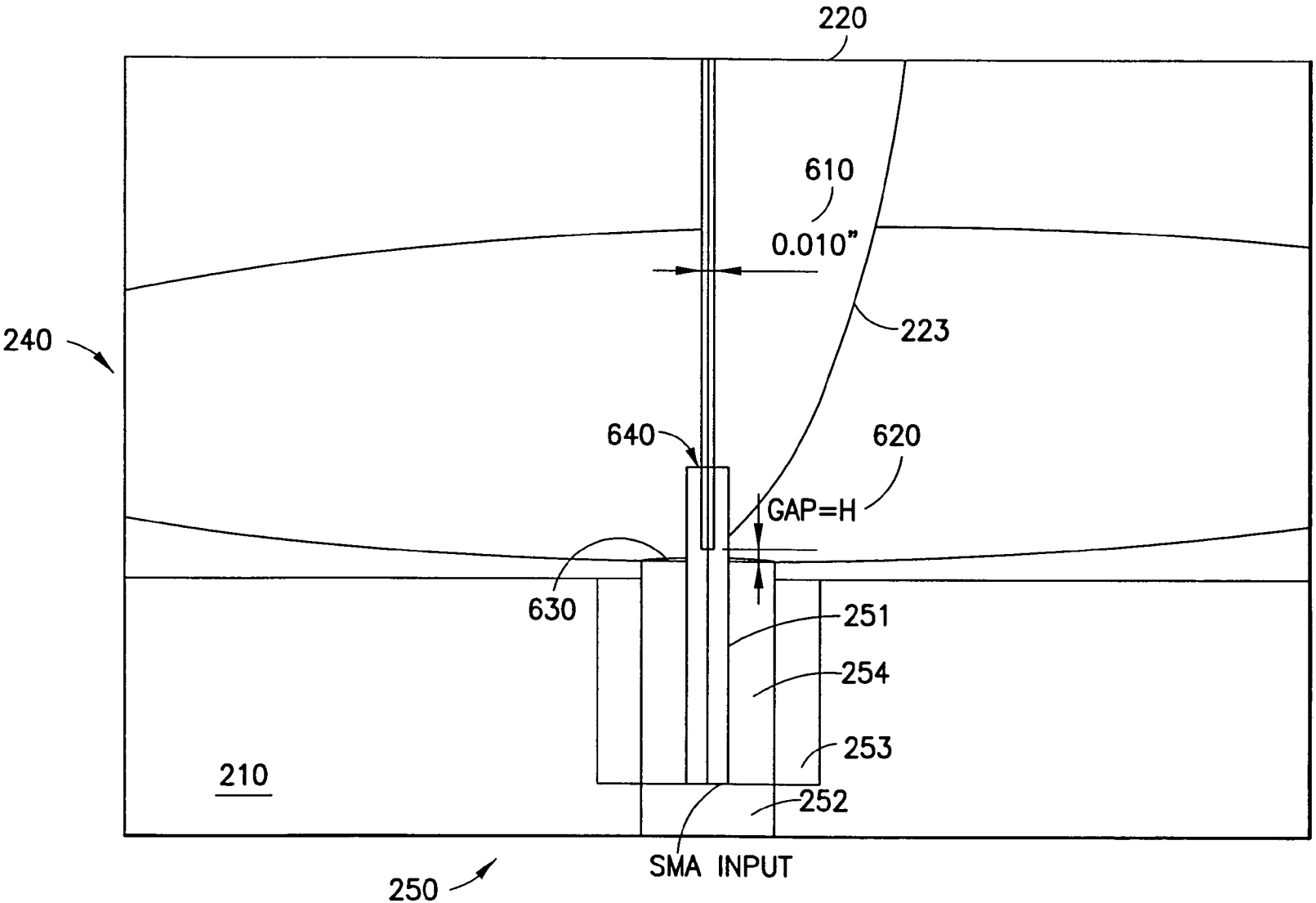
FIG. 6 is a cross-sectional view of the top loaded elliptical disk monopole antenna shown in FIG. 1.

The feed 250, in the exemplary embodiment of FIG. 4, is an SMA input and is shown in better detail in FIG. 6.

Figure 5:
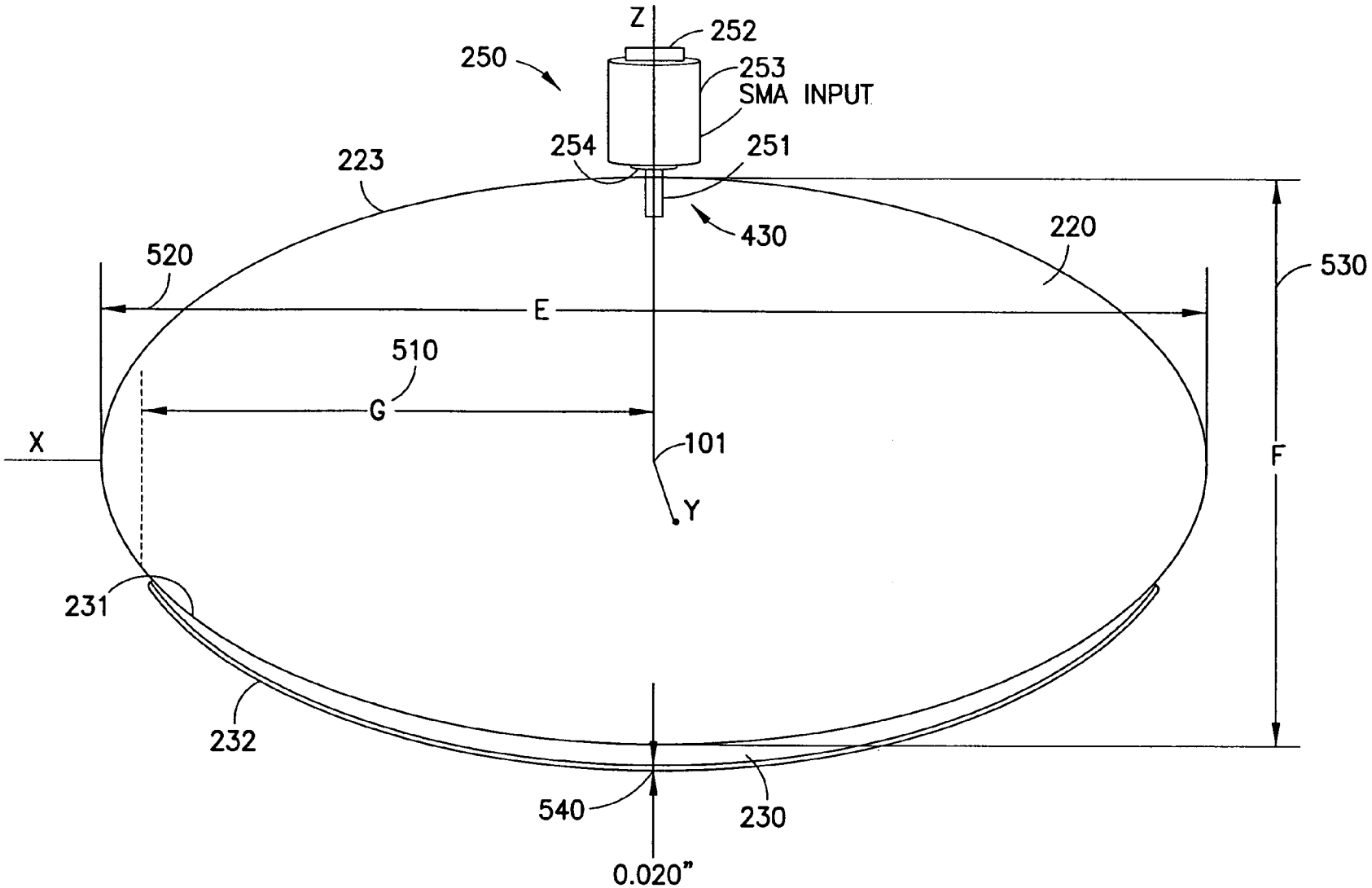
FIG. 5 is another side view (e.g., from a point of view relative to the x-z plane) of the top loaded elliptical disk monopole antenna shown in FIG. 1 and is used to illustrate the elliptical disk and an exemplary feed coupled thereto.

FIG. 5 is another side view (e.g., from a point of view relative to the origin 101 shown in FIG. 1) of the top loaded elliptical disk monopole antenna 200 shown in FIG. 1 and is used to illustrate the elliptical disk 220 and an exemplary feed 250 coupled thereto. In the example of FIG. 5, the feed 250 comprises an SMA input that comprises a center conductor 251, a dielectric 254, a jacket 252, and a connector 253. The center conductor 251 is electrically connected (e.g., through a mechanical coupling such as welding or soldering) to the loading reflector 230, as shown in more detail in FIG. 6. The jacket 252 (e.g., and typically the connector 253) is electrically connected to the ground plane 210 (not shown in FIG. 5). The jacket 252 is a conductor that is insulated from the center conductor 251 by the dielectric 254.

It should be noted that there are multiple types of SMA inputs that could be used as the feed 250. Some SMA inputs use back nuts, coupling nuts, or other connectors 253 to connect the feed 250 to the ground plane 210. Any device that allows connection between a feed 250 and a ground plane 210 of top loaded elliptical disk monopole antenna 200 may be used. Illustratively, the jacket 252 can be made of a conductive material that is coupled to the ground plane 210, or the jacket 252 can be an insulator that surrounds a braid, and the braid is conductive and coupled to the ground plane 210. For simplicity, it is assumed that the jacket 252 is made of a conductive material herein. Additionally, SMA inputs are only one type of feed 250, and any feed 250 suitable for coupling RF energy to or from an antenna may be used.

In the example of FIG. 5, the elliptical disk 220 has a length 520 of E inches and a width 530 of F inches. In an exemplary embodiment, the ratio between A and E is 1.3478 and the ratio between A and F is 1.8675. The loading reflector 230 has a thickness 540 of 0.020 inches and has a length (e.g., relative to the x axis of the coordinate system 100 of FIG. 1) of two times the partial length 510 of G inches, or 2G inches. In an exemplary embodiment, the ratio of A to G is 2.9524. The thickness 540 of 0.020 inches may be varied if desired. The major axis of the ellipse making the elliptical disk 220 is the x axis and the minor axis of the ellipse is the z axis in this example. In FIG. 5, the major axis is substantially parallel (e.g., within plus or minus 10 degrees of parallel) to a plane (e.g., a y-z plane) intersecting the apex 430. It should be noted that major axis of the elliptical disk 220 need not be substantially parallel to the plane intersecting the apex 430, but having the major axis be substantially parallel to the plane intersecting the apex 430 provides more symmetric radiation patterns.

FIG. 6 is a cross-sectional view of the antenna shown in FIG. 1. The elliptical disk 220 has a thickness of 0.010 inches in this example, which may be modified if desired. The gap 620 of H inches between an end 630 of the dielectric 254 (e.g., Teflon) and the perimeter 224 of the elliptical disk 220 is designed to provide a 50 Ohm impedance and can be modified to provide other impedances. In an exemplary embodiment, the ratio between A and H is 155.0. It should also be noted that the gap 620 can be modified depending on the frequency range over which the top loaded elliptical disk monopole antenna 200 operates.

The center conductor 251 has a slot 640 that is adapted to mate with the elliptical disk 220 and to connect electrically to the elliptical disk 220. Typically, the center conductor 251 and the elliptical disk 220 are soldered and/or welded to provide an electrical connection between the center conductor 251 and the elliptical disk 220. The connector 253 is used to couple the jacket 252 to the ground plane 210.

The following table illustrates ratios (a value for the parameter in the table divided by a value for the length of the elliptical cavity 370) for parameters in an exemplary embodiment for the top loaded elliptical disk monopole antenna 200.

| Parameter | Parameter Letter | Ratio |
|---|---|---|
| Length 370 of Elliptical Cavity 240 | A | 1.0000 |
| Width 380 of Elliptical Cavity 240 | B | 1.9375 |
| Width 420 of Loading Reflector 230 | C | 2.9245 |
| Depth 410 of Elliptical Cavity 240 | D | 13.1356 |
| Length 520 of Elliptical Disk 220 | E | 1.3478 |
| Width 530 of Elliptical Disk 220 | F | 1.8675 |
| Partial Length 510 of Loading Reflector 520 | G | 2.9524 |
| Gap 620 Between an end 630 of the Dielectric 254 and the Perimeter 224 of the Elliptical Disk 220 | H | 155.0 |

The ratios of the parameters shown above may be modified to achieve a desired frequency range, radiation pattern, and beam focus. The ratios in the table are merely exemplary. For instance, as described above, the length 370 and width 380 of the elliptical cavity 240 may be modified (e.g., such that there is a change in the ratio between the length 370 and width 380), and such modification will result in radiation pattern changes. As another example, as described above, the width 420 of the loading reflector 230 can be modified, and modification of the width 420 has the greatest effect on a frequency range over which the top loaded elliptical disk monopole antenna 200 can communicate, relative to other possible modifications of parameters of the top loaded elliptical monopole antenna 200. Modification of the width 420 can also change the radiation patterns of the top loaded elliptical disk monopole antenna 200. As yet another example, the elliptical cavity 240 could be made with a zero depth 410, which would make the ratio of A/D be A/zero, which is infinity. It should also be noted that parameters other than the length 370 of the elliptical cavity 240 may be chosen as a "base" parameter used for comparison with other parameters and determination of ratios.

By varying the parameters shown above, the frequency $F_{low}$ may be designed, for instance, from about 1.5 to about 2.0 gigahertz (GHz) with corresponding frequencies $F_{high}$ from about 13.0 GHz to about 18.0 GHz. A reference that may be helpful when determining effects of some of the parameters in the above table is N. P. Agrawall, G. Kumar, and K. P. Ray, "Wideband planar monopole antennas," IEEE Trans on Antennas and Propagation, vol. 46, pp. 294-295, February 1998. Those skilled in the art should be able to use the teachings herein to design a particular frequency range of operation for the antennas described herein.

For the following figures that contain actual measured and theoretical data, the theoretical data were simulated and taken by a High Frequency Selected Surfaces (HFSS) modeling program and the actual measurements were taken in an anechoic chamber. The theoretical data were taken using the cylindrical ground plane 210 shown in FIG. 1, while the actual measurements were taken with an elliptical ground plane that was not concentric with the elliptical cavity 240. Additionally, the theoretical antenna model used for simulations with HFSS was symmetric about all three axes (e.g., of the coordinate system 100 of FIG. 1). The theoretical antenna model did not include an RF cable used to attach to the feed 250.

Moreover, because of the physical antenna asymmetries, it is very difficult to duplicate the cross-polarization data. Consequently, the cross-polarization results in the principal planes ($\phi$=0 degrees, $\phi$=90 degrees) may not represent the correct performance. Additionally, the ends of the ground plane of both theoretical and physical antenna models may have introduced incorrect radiation characteristics for the angle cut for $\phi$=0 degrees for $\theta$ greater than 84 degrees (most notable at high frequencies). The angle cut for $\phi$=90 degrees indicates correct results.

FIGS. 7 through 20 were performed using a top loaded elliptical monopole antenna 200 having the ratios in the table given above.

Figure 7:
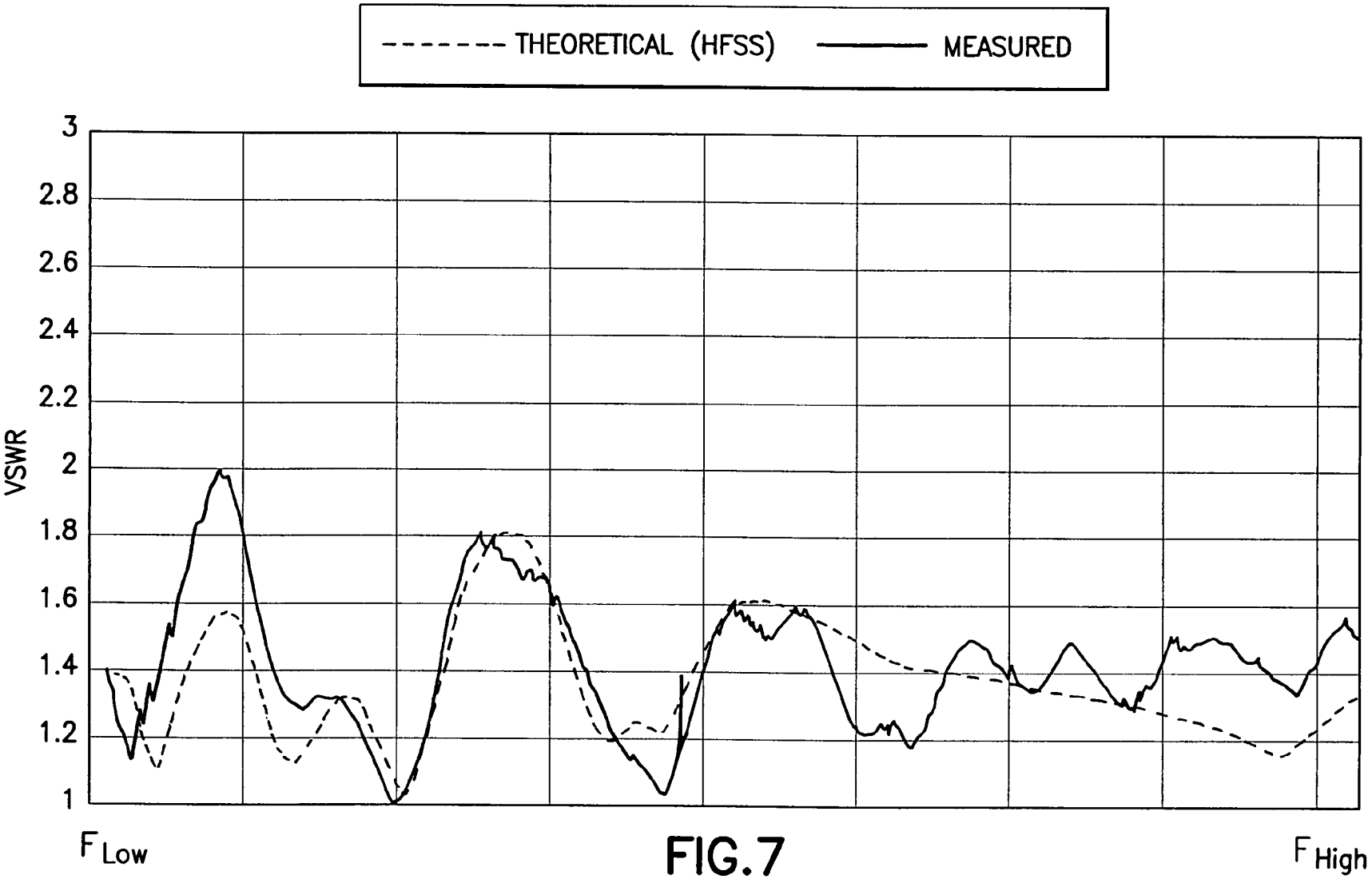
FIG. 7 is a graph of measured versus theoretical Voltage Standing Wave Ratio (VSWR) from exemplary frequencies $F_{low}$ to $F_{high}$ for simulated and actual top loaded elliptical disk monopole antennas.

FIG. 7 is a graph of measured versus theoretical Voltage Standing Wave Ratio (VSWR) from exemplary frequencies $F_{low}$ to $F_{high}$ for simulated and actual top loaded elliptical disk monopole antennas.

Figure 8:
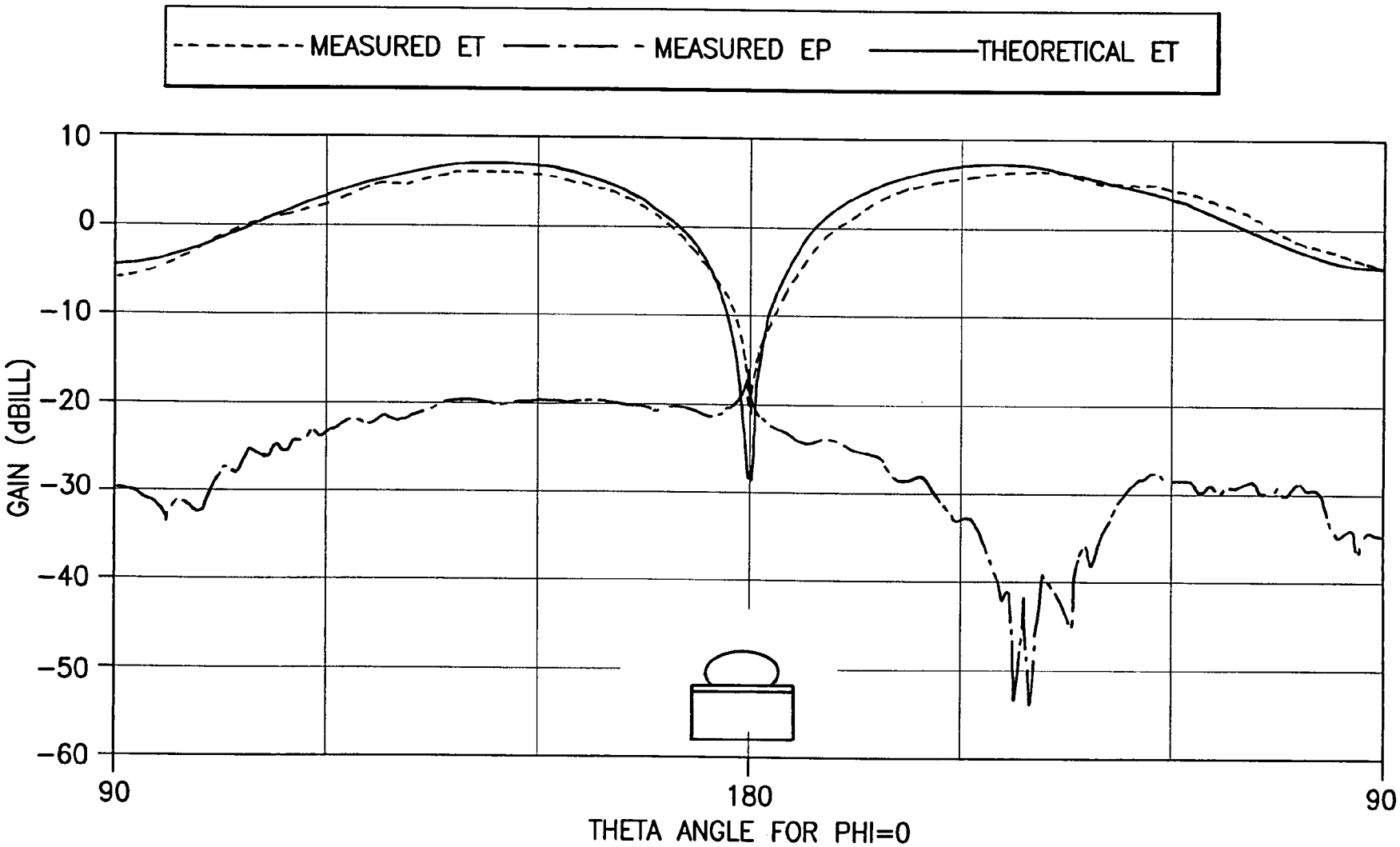
FIG. 8 is a graph of measured and theoretical vertical Eθ (ET) and measured horizontal Eϕ (EP) polarizations as θ varies from 90 degrees, through 180 degrees, to 90 degrees at ϕ=0 degrees and at $F_{low}$+2 gigahertz (GHz)

FIG. 8 is a graph of measured and theoretical vertical E$\theta$ (ET) and measured horizontal E$\phi$ (EP, e.g. horizontal) polarizations as $\theta$ varies from 90 degrees, through 180 degrees, to 90 degrees at $\phi$=0 degrees and at $F_{low}$+2 gigahertz (GHz).

Figure 9:
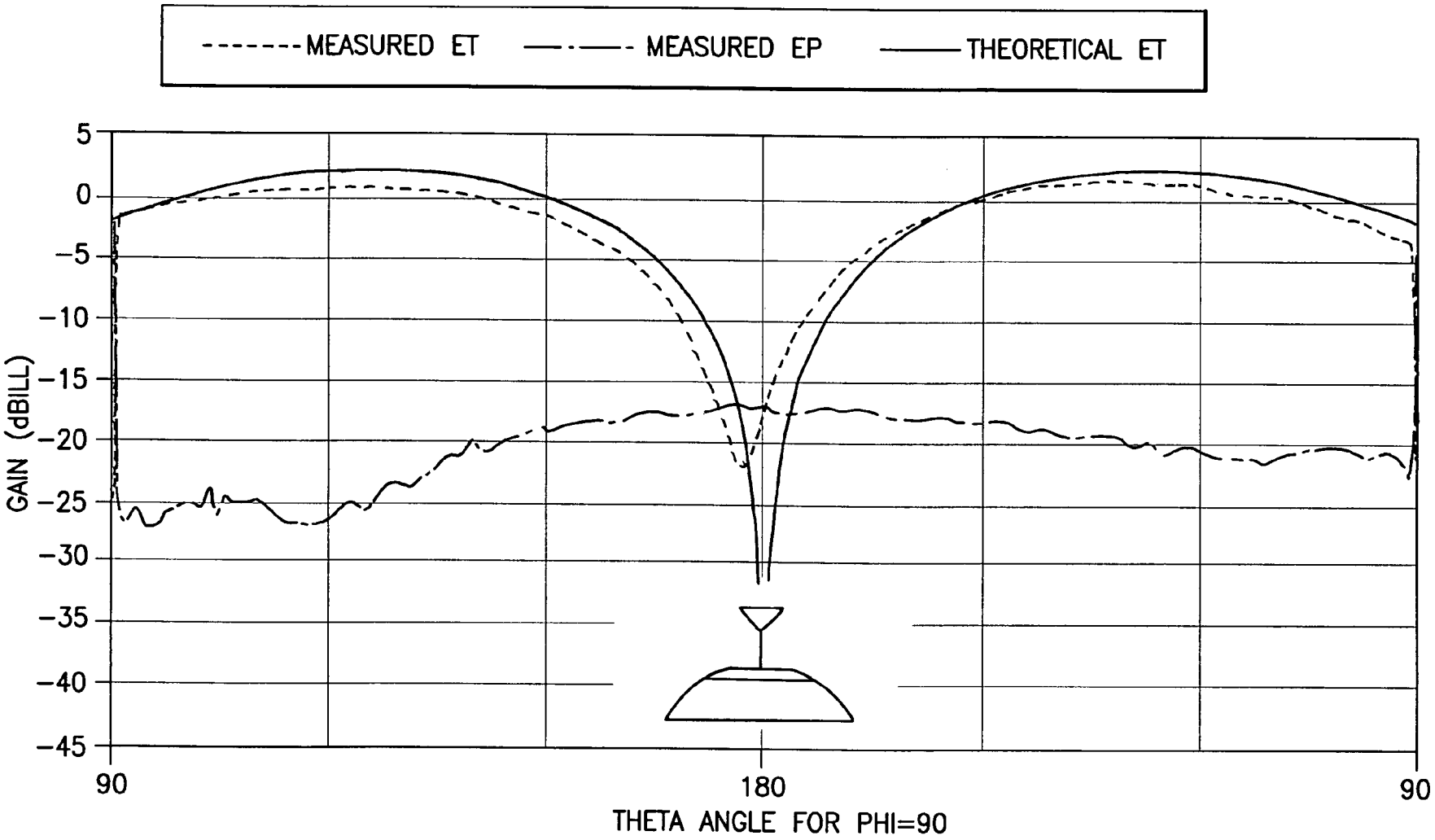
FIG. 9 is a graph of measured and theoretical Eθ (ET) and measured Eϕ (EP) polarizations as θ varies from 90 degrees, through 180 degrees, to 90 degrees at ϕ=90 degrees and at $F_{low}$+2 gigahertz (GHz)

FIG. 9 is a graph of measured and theoretical E$\theta$ (ET) and measured E$\phi$ (EP) polarizations as $\theta$ varies from 90 degrees, through 180 degrees, to 90 degrees at $\phi$=90 degrees and at $F_{low}$+2 gigahertz (GHz).

Figure 10:
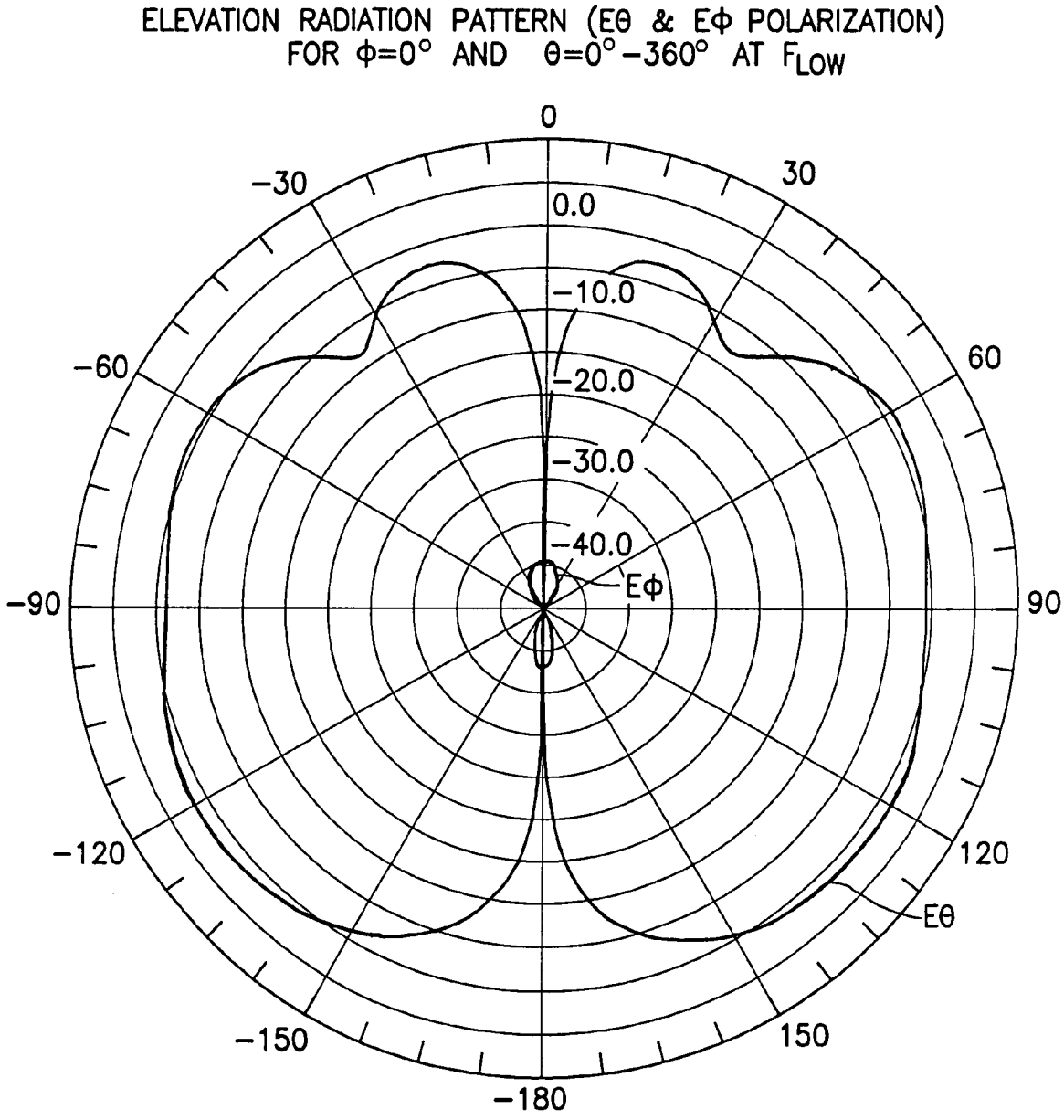
FIG. 10 is a polarization plot (Eθ and Eϕ polarizations) of an elevation radiation pattern for ϕ=0 degrees and θ=0-360 degrees at $F_{low}$.

FIG. 10 is a polarization plot (E$\theta$ and E$\phi$ polarizations) of an elevation radiation pattern for $\phi$=0 degrees and $\theta$=0-360 degrees at $F_{low}$.

Figure 11:
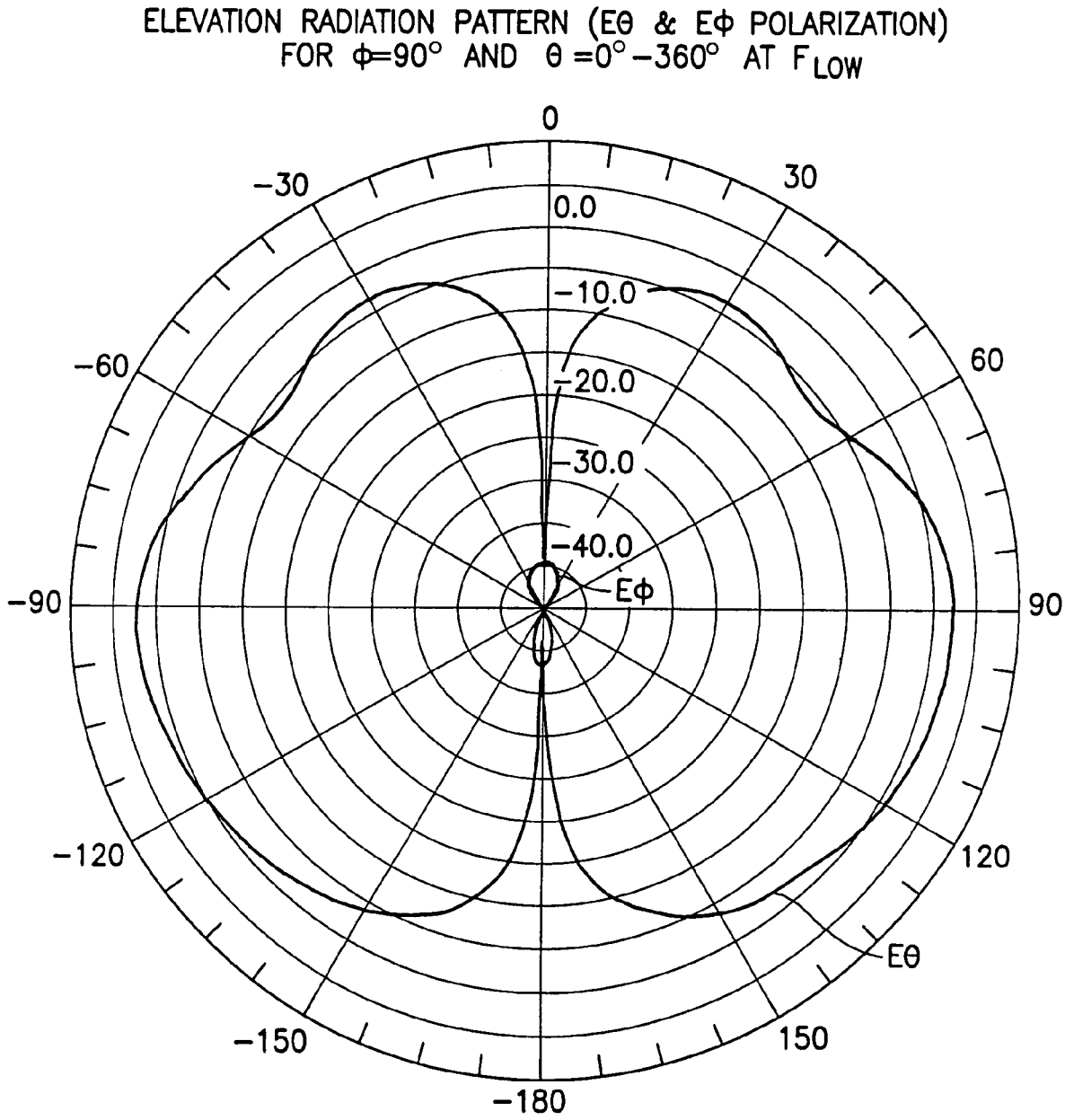
FIG. 11 is a polarization plot (Eθ and Eϕ polarizations) of an elevation radiation pattern for ϕ=90 degrees and θ=0-360 degrees at $F_{low}$.

FIG. 11 is a polarization plot (E$\theta$ and E$\phi$ polarizations) of an elevation radiation pattern for $\phi$=90 degrees and $\theta$=0-360 degrees at $F_{low}$.

Figure 12:
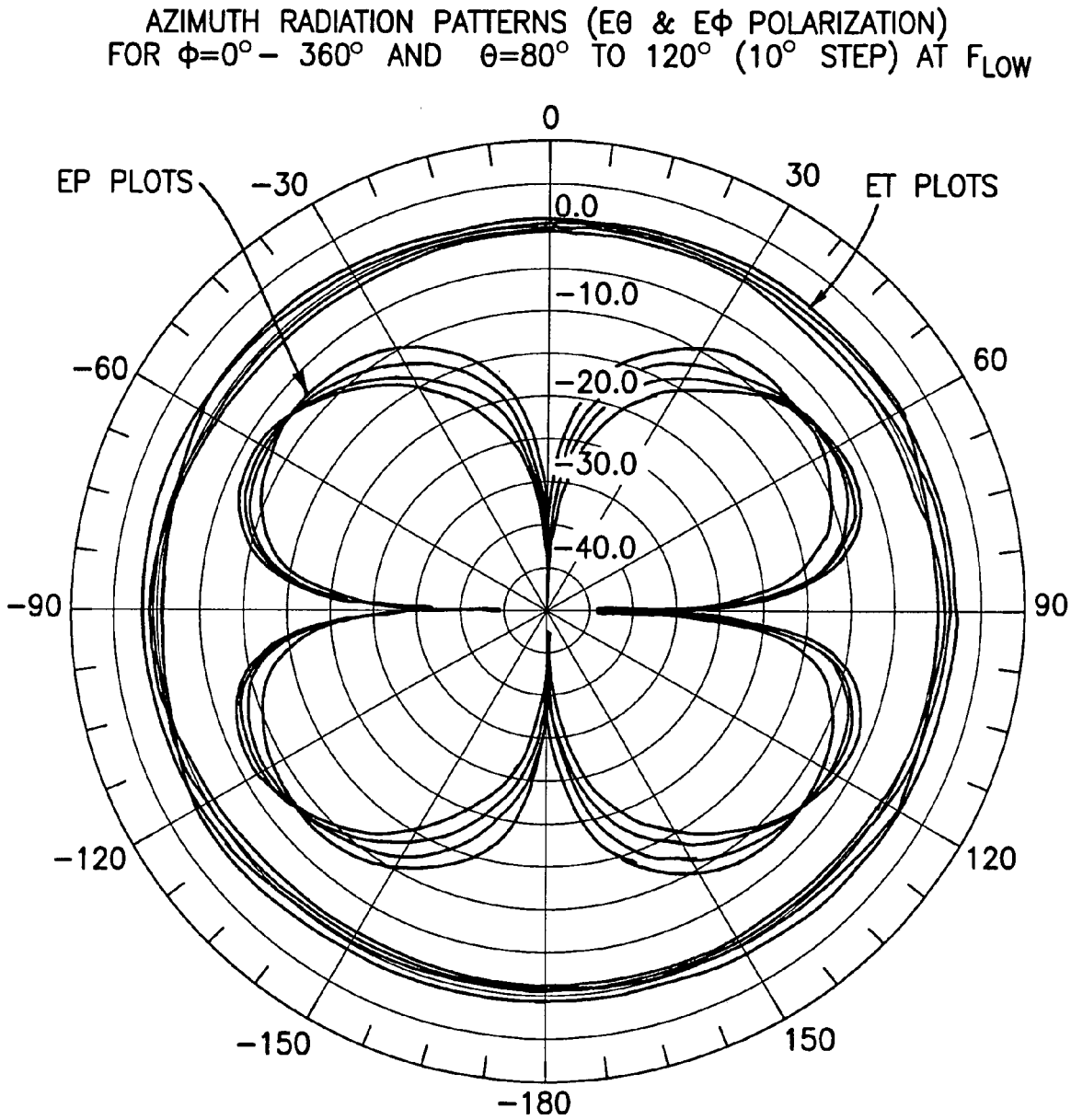
FIG. 12 is a polarization plot (Eθ and Eϕ polarizations) of azimuth radiation patterns for ϕ=0-360 degrees and θ=80-120 degrees (in 10 degree steps) at $F_{low}$.

FIG. 12 is a polarization plot (E$\theta$ and E$\phi$ polarizations) of azimuth radiation patterns for $\phi$=0-360 degrees and $\theta$=80-120 degrees (in 10 degree steps) at $F_{low}$.

Figure 13:
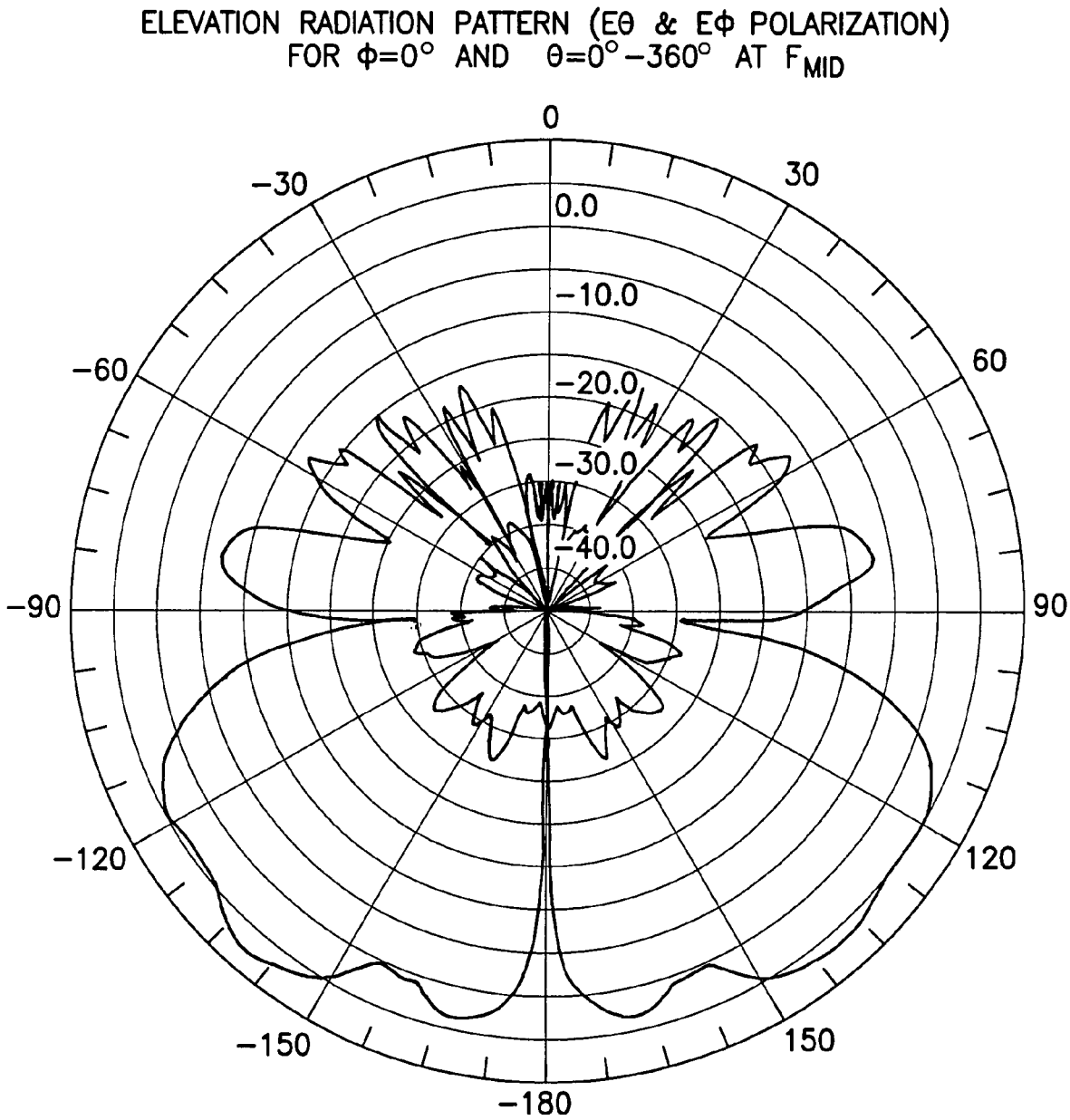
FIG. 13 is a polarization plot (Eθ and Eϕ polarizations) of an elevation radiation pattern for ϕ=0 degrees and θ=0-360 degrees at $F_{mid}$.

FIG. 13 is a polarization plot (E$\theta$ and E$\phi$ polarizations) of an elevation radiation pattern for $\phi$=0 degrees and $\theta$=0-360 degrees at $F_{mid}$.

Figure 14:
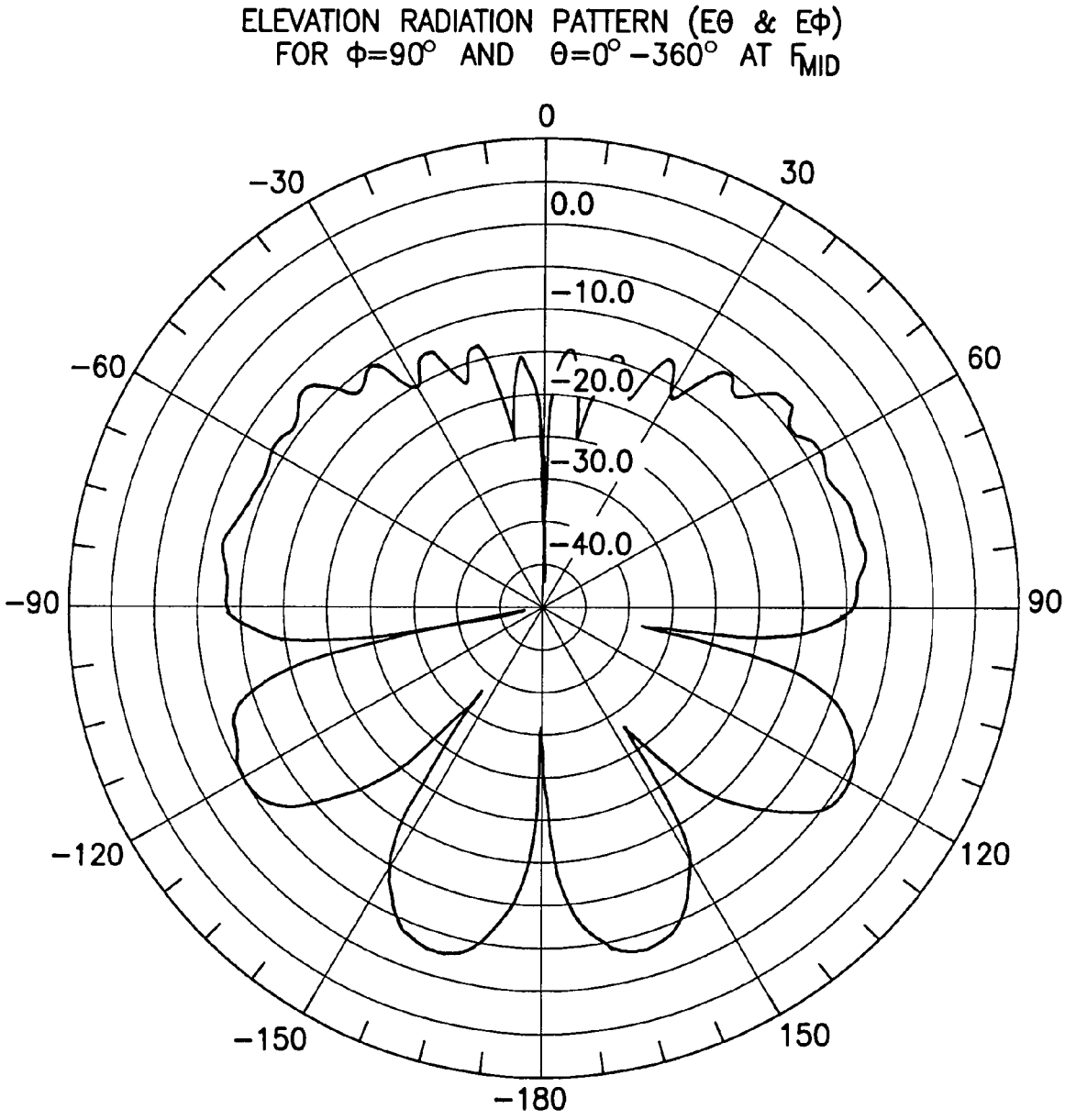
FIG. 14 is a polarization plot (Eθ and Eϕ polarizations) of an elevation radiation pattern for ϕ32 90 degrees and θ=0-360 degrees at $F_{mid}$.

FIG. 14 is a polarization plot (E$\theta$ and E$\phi$ polarizations) of an elevation radiation pattern for $\phi$=90 degrees and $\theta$=0-360 degrees at $F_{mid}$.

Figure 15:
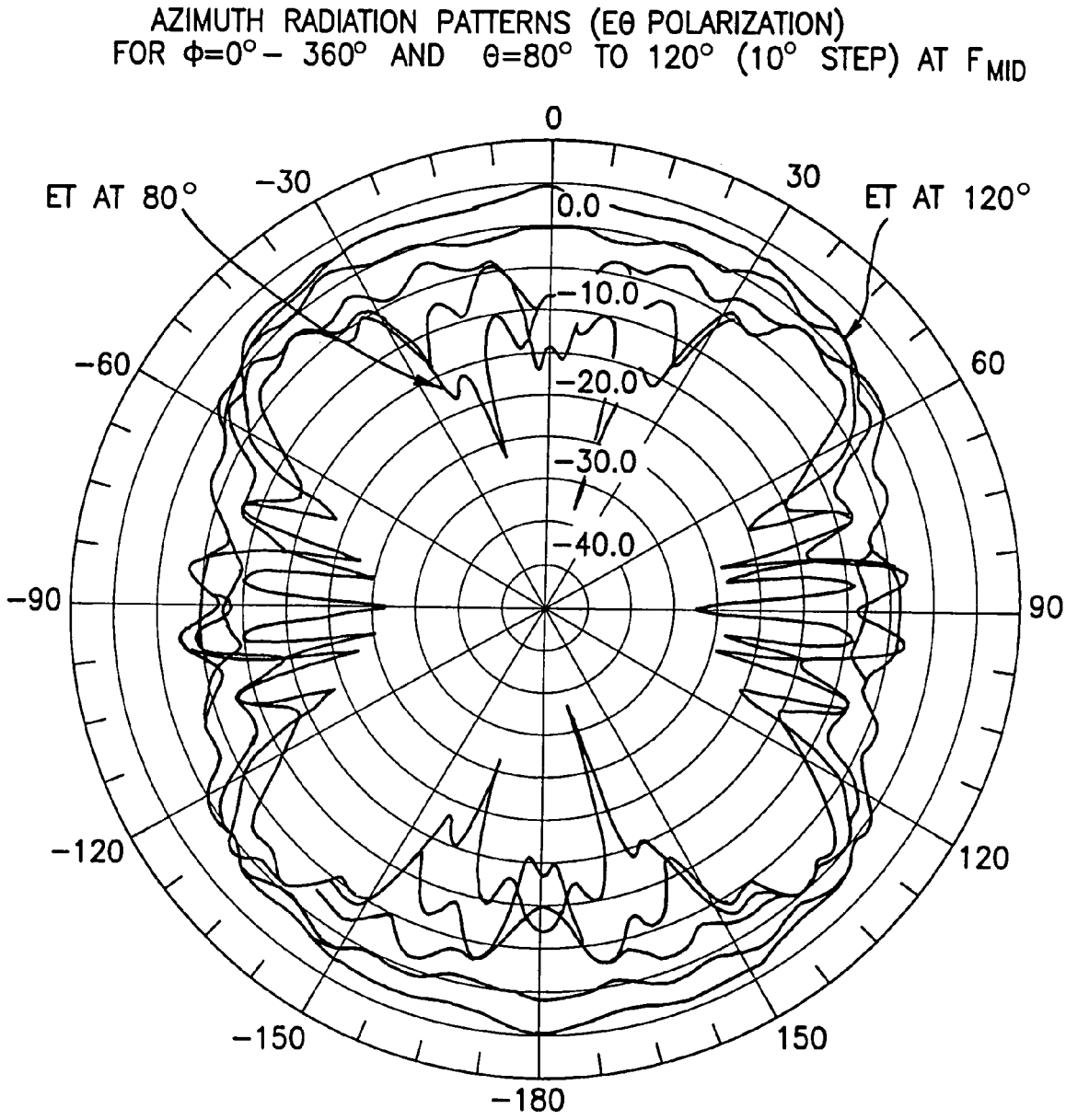
FIG. 15 is a polarization plot (Eθ polarization) of azimuth radiation patterns for ϕ=0-360 degrees and θ=80-120 degrees (in 10 degree steps) at $F_{mid}$.

FIG. 15 is a polarization plot (E$\theta$ polarization) of azimuth radiation patterns for $\phi$=0-360 degrees and $\theta$=80-120 degrees (in 10 degree steps) at $F_{mid}$.

Figure 16:
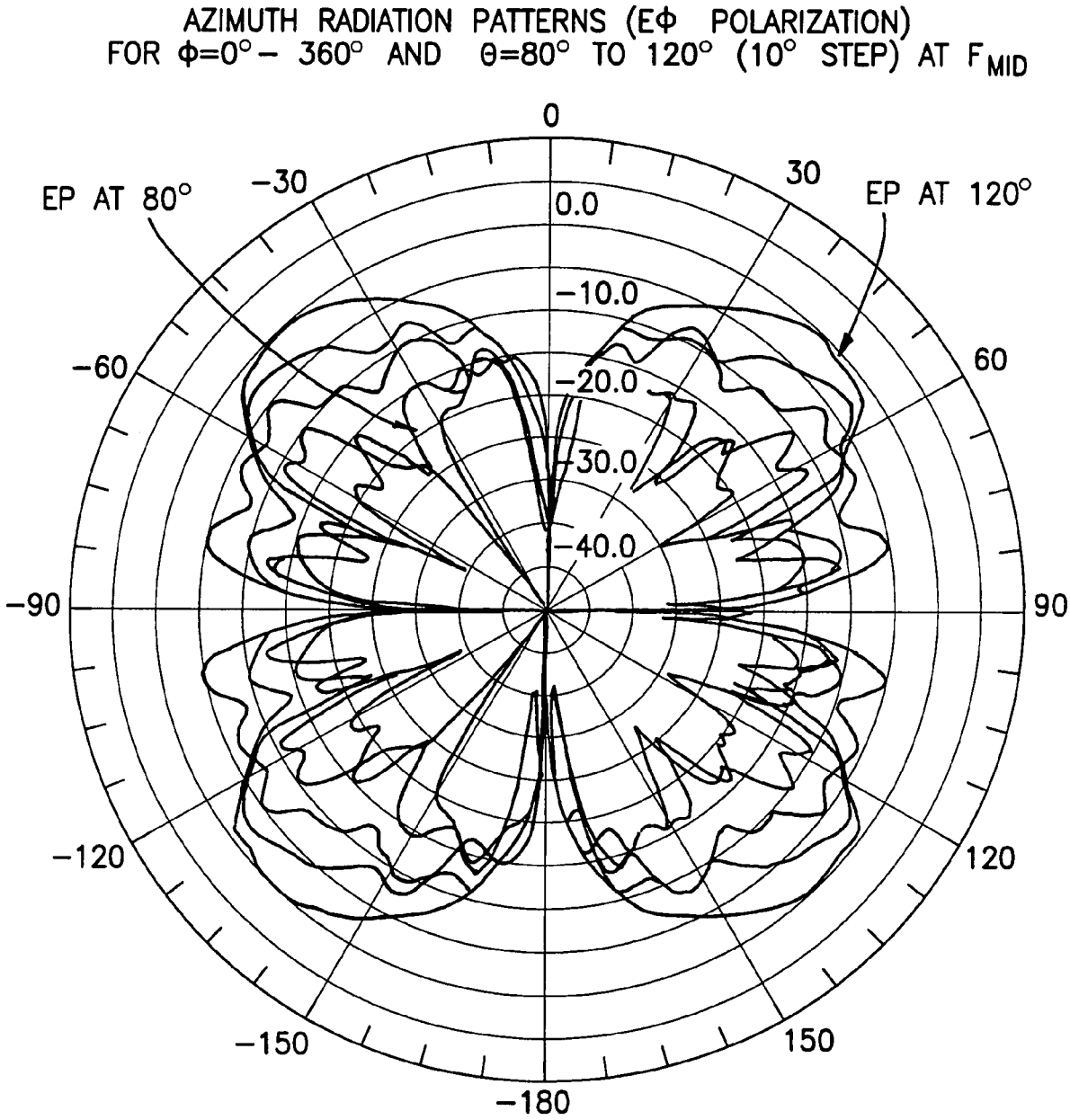
FIG. 16 is a polarization plot (Eϕ polarization) of azimuth radiation patterns for ϕ=0-360 degrees and θ=80-120 degrees (in 10 degree steps) at $F_{mid}$.

FIG. 16 is a polarization plot (E$\phi$ polarization) of azimuth radiation patterns for $\phi$=0-360 degrees and $\theta$=80-120 degrees (in 10 degree steps) at $F_{mid}$.

Figure 17:
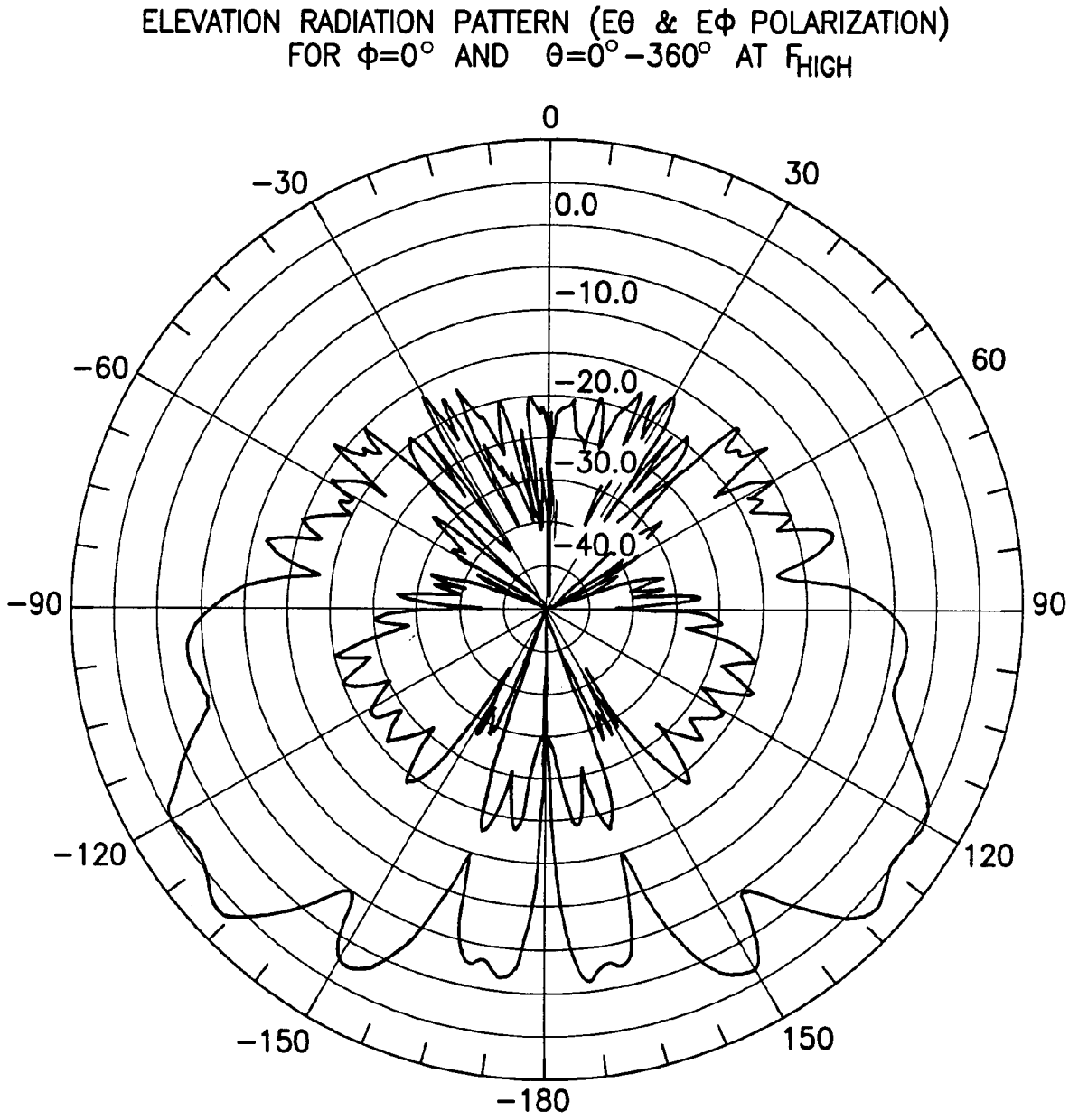
FIG. 17 is a polarization plot (Eθ and Eϕ polarizations) of an elevation radiation pattern for ϕ=0 degrees and θ=0-360 degrees at $F_{high}$.

FIG. 17 is a polarization plot (E$\theta$ and E$\phi$ polarizations) of an elevation radiation pattern for $\phi$=0 degrees and $\theta$=0-360 degrees at $F_{high}$.

Figure 18:
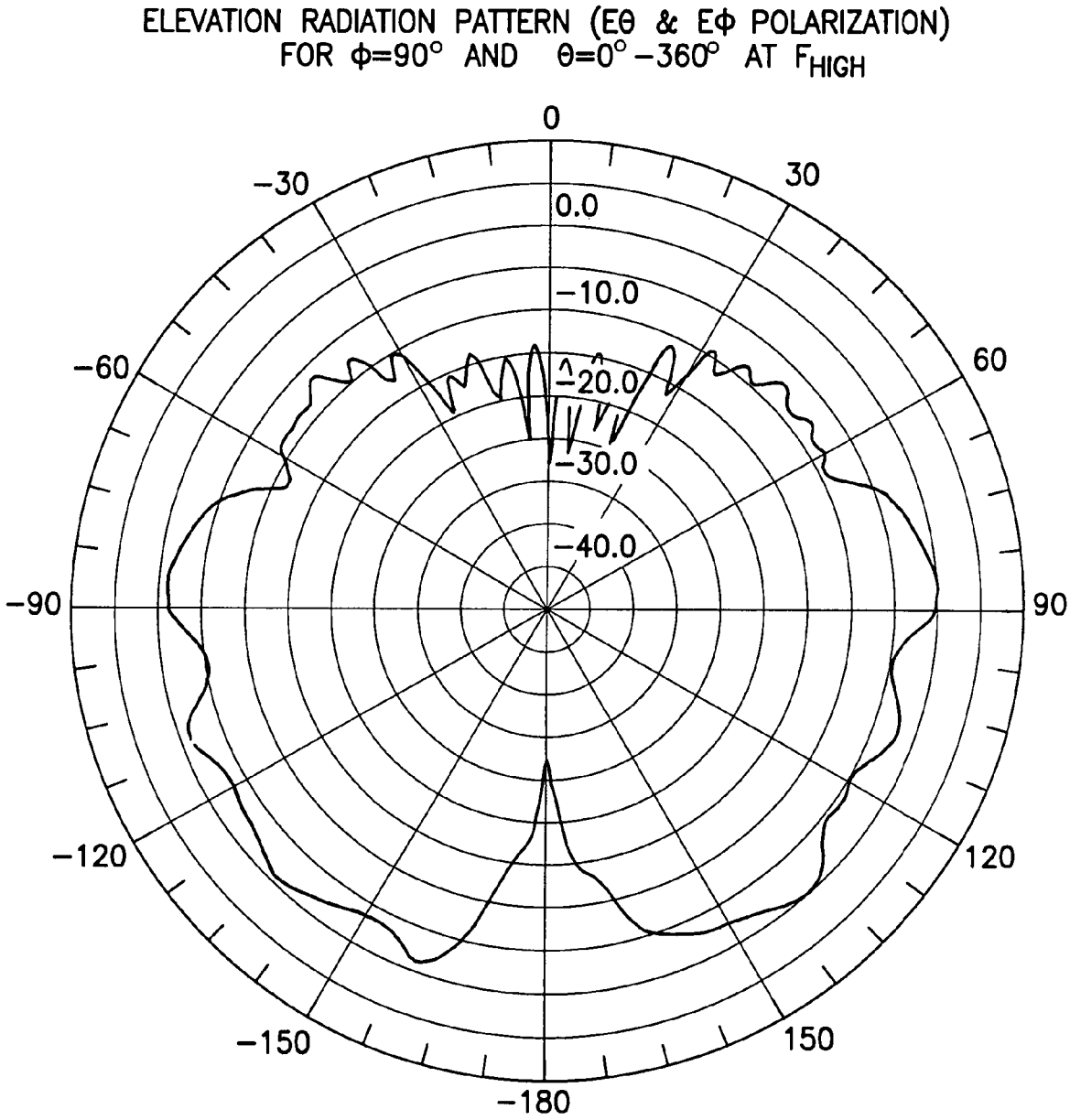
FIG. 18 is a polarization plot (Eθ and Eϕ polarizations) of an elevation radiation pattern for ϕ=90 degrees and θ=0-360 degrees at $F_{high}$.

FIG. 18 is a polarization plot (E$\theta$ and E$\phi$ polarizations) of an elevation radiation pattern for $\phi$=90 degrees and $\theta$=0-360 degrees at $F_{high}$.

Figure 19:
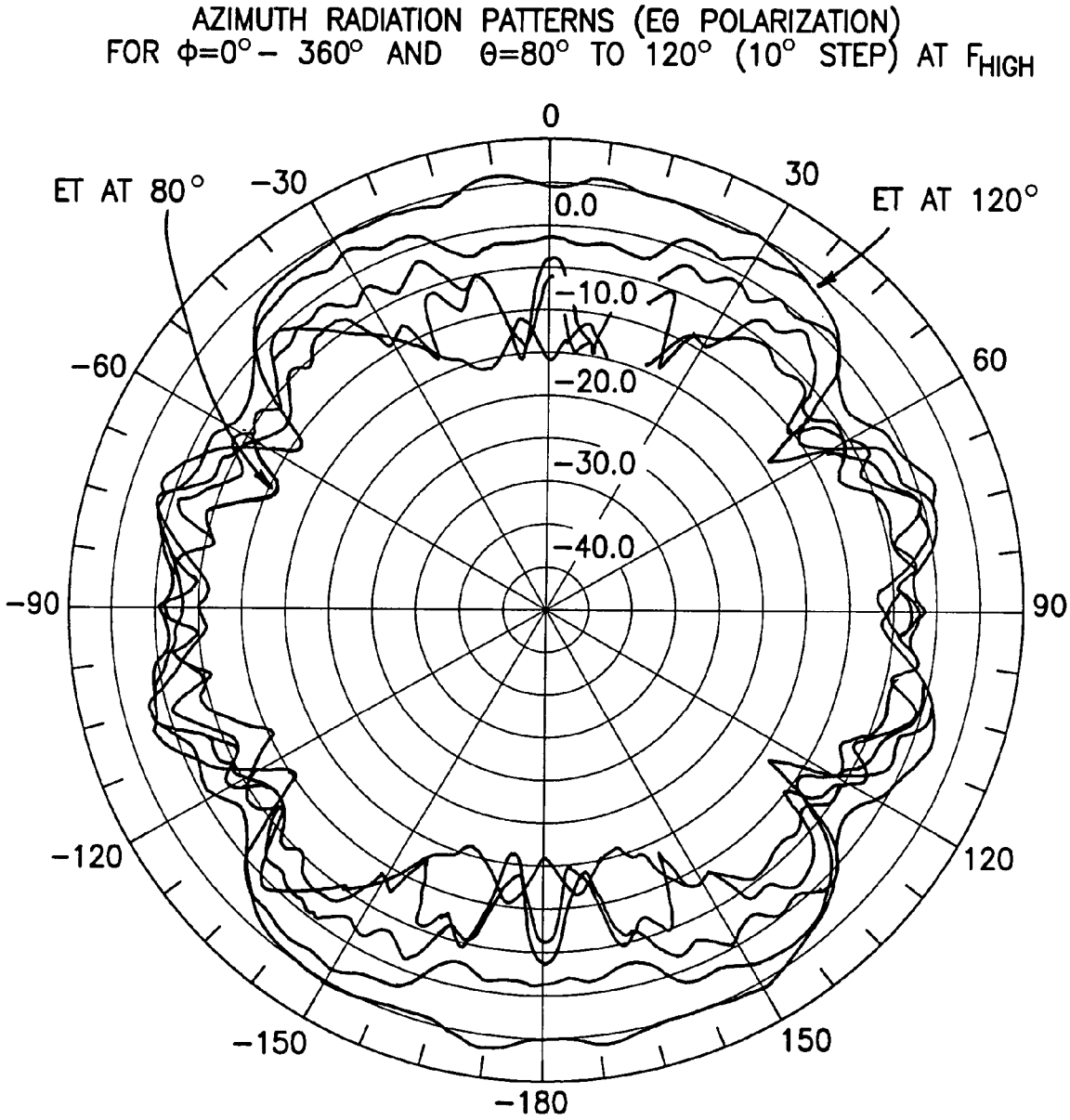
FIG. 19 is a polarization plot (Eθ polarization) of azimuth radiation patterns for ϕ=0-360 degrees and θ=80-120 degrees (in 10 degree steps) at $F_{high}$.

FIG. 19 is a polarization plot (E$\theta$ polarization) of azimuth radiation patterns for $\phi$=0-360 degrees and $\theta$=80-120 degrees (in 10 degree steps) at $F_{high}$.

Figure 20:
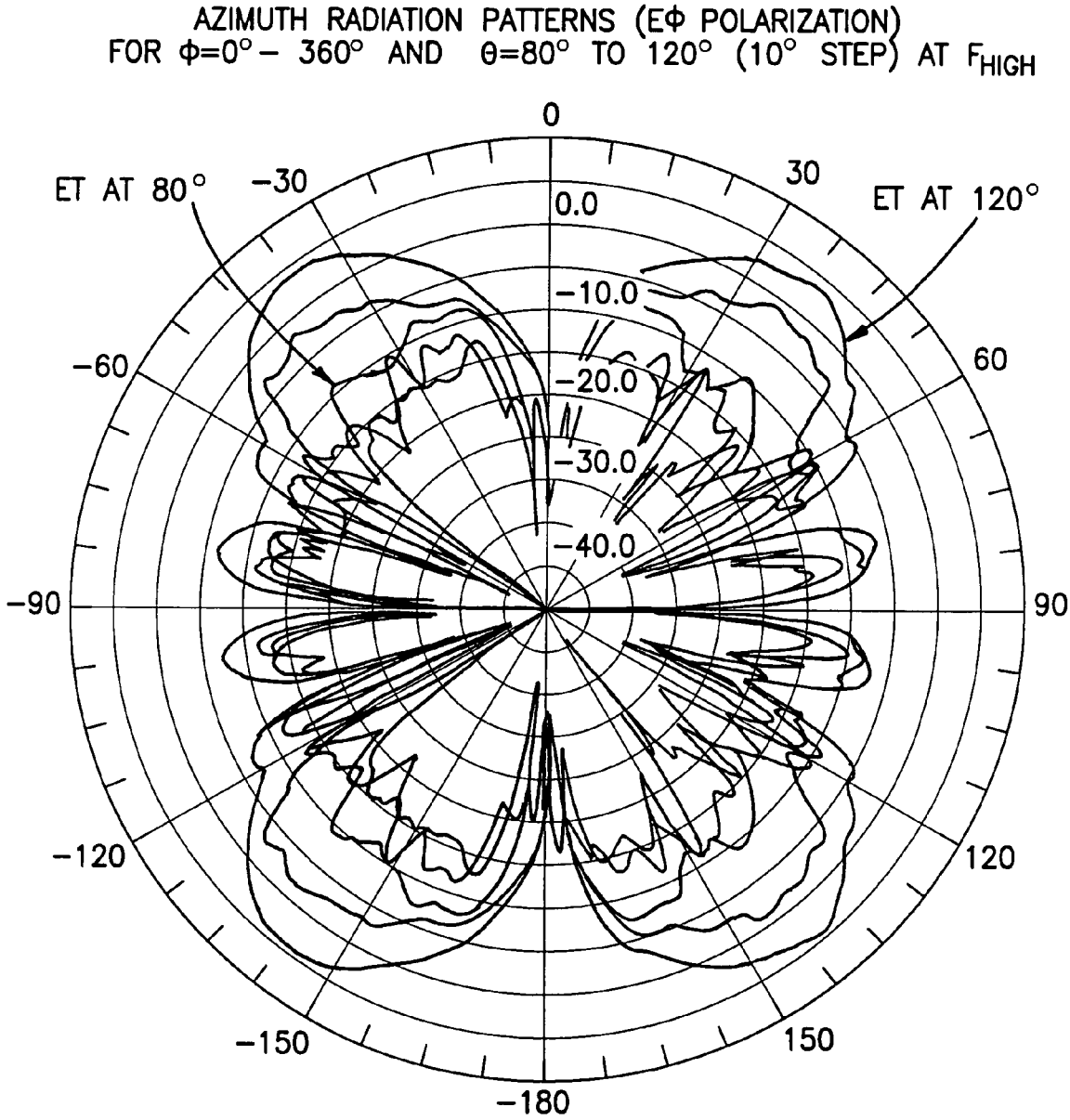
FIG. 20 is a polarization plot (Eϕ polarization) of azimuth radiation patterns for ϕ=0-360 degrees and θ=80-120 degrees (in 10 degree steps) at $F_{high}$.

FIG. 20 is a polarization plot (E$\phi$ polarization) of azimuth radiation patterns for $\phi$=0-360 degrees and $\theta$=80-120 degrees (in 10 degree steps) at $F_{high}$.

The foregoing description has provided by way of exemplary and non-limiting examples a full and informative description of the best method and apparatus presently contemplated by the inventors for carrying out the invention. However, various modifications and adaptations may become apparent to those skilled in the relevant arts in view of the foregoing description, when read in conjunction with the accompanying drawings and the appended claims. Nonetheless, all such and similar modifications of the teachings of this invention will still fall within the scope of this invention.

Furthermore, some of the features of the preferred embodiments of this invention could be used to advantage without the corresponding use of other features. As such, the foregoing description should be considered as merely illustrative of the principles of the present invention, and not in limitation thereof.

What is claimed is:

1. An antenna comprising:

a ground plane;

a disk disposed adjacent to the ground plane and having a perimeter, and a loading reflector having an underside, at least a portion of the underside being electrically connected to a portion of the perimeter of the disk, the loading reflector having a width at a widest point, the width at the widest point of the loading reflector being larger than a thickness of the disk, the loading reflector situated such that at least the portion of the underside overlies the disk and another portion of the loading reflector overlies the ground plane but does not overlie the disk, the loading reflector situated such that at least the portion of the underside overlies the disk and another portion of the loading reflector overlies the ground plane but does not overlie the disk.

2. The antenna of claim 1, wherein the disk comprises a circular disk.

3. The antenna of claim 1, wherein the disk comprises an elliptical disk.

4. The antenna of claim 3, wherein;

the ground plane has a surface;

the elliptical disk has a length defined along a major axis of the elliptical disk and a width defined along a minor axis of the elliptical disk;

the length of the elliptical disk is larger than the width of the elliptical disk; and the major axis is substantially parallel to the surface of the ground plane.

5. The antenna of claim 3, wherein:

the ground plane has a surface;

the elliptical disk has a length defined along a major axis of the elliptical disk and a width defined along a minor axis of the elliptical disk;

the length of the elliptical disk is larger than the width of the elliptical disk; and the minor axis is substantially parallel to the surface of the ground plane.

6. The antenna of claim 1, wherein:

the ground plane comprises a cavity having an outer border; and the is disposed adjacent to the cavity.

7. The antenna of claim 6, wherein the disk is disposed within the outer border.

8. The antenna of claim 6, wherein:

the outer border is elliptical such that the cavity comprises an elliptical cavity having major and minor axes;

the disk comprises an elliptical disk having major and minor axes: and the major axis of the elliptical cavity and the minor axis of the elliptical disk are substantially parallel.

9. The antenna of claim 6, wherein:

the outer border is elliptical such that to cavity comprises an elliptical cavity having major and minor axes;

the disk comprises an elliptical disk having major and minor axes; and the major axis of the elliptical cavity and the minor axis of the elliptical disk are not substantially parallel.

10. The antenna of claim 6, wherein:

the outer border is elliptical such that the cavity comprises an elliptical cavity having major and minor axes;

the disk comprises an elliptical disk having major and minor axes;

the major axes of the elliptical cavity and the elliptical disk are substantially parallel; and the disk is disposed within the outer border of the cavity.

11. The antenna of claim 10, wherein the elliptical cavity has a depth at an apex of the elliptical cavity.

12. The antenna of claim 10, wherein:

the elliptical cavity has a length defined along the major axis of the elliptical cavity;

the elliptical cavity has a width defined along the minor axis of the elliptical cavity;

the elliptical disk has a length defined along a major axis of the elliptical disk and a width defined along a minor axis of the elliptical disk;

the major axes of the elliptical cavity and elliptical disk are substantially parallel; and the length of the elliptical cavity Is larger than the length of the elliptical disk.

13. The antenna of claim 1, wherein a midpoint of the loading reflector is substantially opposite a given point on the ground plane.

14. The antenna of claim 13, wherein:

the ground plane comprises an elliptical cavity having an apex; and the given point is the apex.

15. The antenna of claim 1, wherein the round plane comprises a cavity and a surface surrounding the cavity is substantially flat.

16. The antenna of claim 1, further comprising a feed coupled to the disk and to the ground plane.

17. The antenna of claim 16, wherein the feed comprises a first conductor coupled to the disk and a second conductor coupled to the ground plane.

18. The antenna of claim 17, wherein the feed further comprises a dielectric interposed between the first and second conductors and the feed is defined so that the perimeter is situated a predetermined distance from the dielectric in order to provide a predetermined impedance for the feed.

19. The antenna of claim 17, wherein the first conductor comprises a slot adapted to mate with the disk.

20. The antenna of claim 1, wherein the loading reflector comprises a length defined at least in part by the portion of the underside that overlies the disk and comprises first and second partial widths occurring at the widest point, and wherein the other portion of the loading reflector comprises a first area formed by the length and by the first partial width and a second area formed by the length and the second partial width.

21. The antenna of claim 20, wherein the first and second areas are the same, such that the loading reflector is symmetric about the disk.

22. An antenna comprising:

a ground plane comprising an elliptical cavity having a parabolic surface;

an elliptical disk disposed adjacent to the elliptical cavity, the elliptical disk having a major axis substantially parallel to a plane intersecting an apex of the parabolic surface, the elliptical disk also having a minor axis substantially perpendicular to the plane;

a feed comprising a first conductor coupled to the elliptical disk and a second conductor coupled to the ground plane; and a loading reflector having an underside, at least a portion of the underside being electrically connected to a portion of the perimeter of the disk, the portion substantially opposite the elliptical cavity, the loading reflector having a width at a widest point, the width at the widest point larger than a thickness of the disk.

23. An antenna comprising:

means for reflecting radio frequency signals;

means for radiating radio frequency signals, the radiating means comprising a disk disposed adjacent to the reflecting means and having a perimeter and a thickness;

means for focusing and reflecting radio frequency signals onto at least die radiating means, tile means for focusing and reflecting having an underside and a width, the width at a widest point of die focusing and reflecting means being larger than the thickness of the radiating means; and means for electrically coupling the underside of the focusing and reflecting means to the perimeter of the radiating means.

24. The antenna of claim 23, where the mean for focusing and reflecting radio frequency signals is a first means for focusing and reflecting radio frequency signals and the means for reflecting radio frequency signals is a second means for focusing and reflecting radio frequency signals.

25. The antenna of claim 23, wherein the means for reflecting radio frequency signals is grounded.

26. The antenna of claim 23, wherein radiating means is disposed between the focusing and reflecting means and the reflecting means.

27. The antenna of claim 23, wherein the radiating means is disposed substantially perpendicular to at least one point on the reflecting means.

28. An antenna comprising:

a ground plane comprising a cavity having an outer border;

a disk disposed adjacent to the cavity and having a perimeter, and a loading reflector having an underside, at least a portion of the underside being electrically connected to a portion of the perimeter of the disk, the loading reflector having a width at a widest point, the width at the widest point of the loading reflector being larger than a thickness of the disk.

29. The antenna of claim 28, wherein the disk is disposed within the outer border.

30. The antenna of claim 28, wherein:

the outer border is elliptical such that the cavity comprises an elliptical cavity having major and minor axes;

the disk comprises an elliptical disk having major and minor axes; and the major axis of the elliptical cavity and the minor axis of the elliptical disk are substantially parallel.

* * * * *